US011300373B2

(12) United States Patent
Woods, III

(10) Patent No.: US 11,300,373 B2
(45) Date of Patent: Apr. 12, 2022

(54) REVOLVER RELOADING DEVICE

(71) Applicant: Obsolete Arms LLC, Norcross, GA (US)

(72) Inventor: William Aloysious Woods, III, Norcross, GA (US)

(73) Assignee: Obsolete Arms LLC, Norcross, GA (US)

( * ) Notice: Subject to any disclaimer, the term of this patent is extended or adjusted under 35 U.S.C. 154(b) by 0 days.

(21) Appl. No.: 17/135,751

(22) Filed: Dec. 28, 2020

(65) Prior Publication Data

US 2021/0199398 A1 Jul. 1, 2021

Related U.S. Application Data

(60) Provisional application No. 62/955,094, filed on Dec. 30, 2019.

(51) Int. Cl.
*F41A 9/85* (2006.01)

(52) U.S. Cl.
CPC ..... *F41A 9/85* (2013.01)

(58) Field of Classification Search
CPC ..... F41A 9/85
USPC ..... 42/89
See application file for complete search history.

(56) References Cited

U.S. PATENT DOCUMENTS 354,454 A * 12/1886 Wesson ..... F41A 9/85 42/89
1,137,543 A * 4/1915 Sergeeff ..... F41A 9/85 42/89
1,231,106 A 6/1917 Wesson
1,835,517 A * 12/1931 Otto ..... F41A 9/85 42/89
1,891,437 A 12/1932 Milmore
1,964,171 A * 6/1934 Pflaume ..... F41A 9/85 42/89

(Continued)

FOREIGN PATENT DOCUMENTS

| | | |
|---|---|---|
| CN | 101943543 | 1/2011 |
| CN | 206601070 | 10/2017 |
| GB | 398690 | 9/1933 |

OTHER PUBLICATIONS

Revolverguy.com; Article entitled: "The CK Tactical Ripcord Speedloader", published Jan. 26, 2019, 10 pgs.

*Primary Examiner* — Bret Hayes
(74) *Attorney, Agent, or Firm* — Taylor English Duma LLP

(57) ABSTRACT

A revolver reloading device includes a first wing assembly defining a first cartridge pocket and a second cartridge pocket, the first cartridge pocket defining a first center point, the second cartridge pocket defining a second center point; a second wing assembly defining a third cartridge pocket, the third cartridge pocket defining a third center point; and a center assembly hingedly coupled to the first wing assembly and the second wing assembly, the first wing assembly and the second wing assembly selectively rotatable relative to the center assembly about and between a flat configuration and a collapsed configuration, the first center point, the second center point, and the third center point being aligned in a linear arrangement in the flat configuration, the first center point, the second center point, and the third center point being aligned in a circular pattern in the collapsed configuration.

20 Claims, 20 Drawing Sheets

(56) References Cited

U.S. PATENT DOCUMENTS

| | | | | | |
|---|---|---|---|---|---|
| 1,969,817 | A | * | 8/1934 | Milmore | F41A 9/85 42/89 |
| 2,073,436 | A | * | 3/1937 | Woodhead | F41A 9/85 42/89 |
| 2,406,231 | A | * | 8/1946 | Lima | F41A 9/85 42/89 |
| 2,406,232 | A | * | 8/1946 | Lima | F41A 9/85 42/89 |
| 3,213,559 | A | | 10/1965 | Matich | |
| 3,667,146 | A | | 6/1972 | Dupouy | |
| 3,785,077 | A | * | 1/1974 | Price | F41A 9/85 42/89 |
| 4,614,053 | A | | 9/1986 | Billman | |
| 4,862,622 | A | | 9/1989 | Goyanes | |
| 7,363,845 | B2 | | 4/2008 | McClellan | |
| 10,209,018 | B1 | | 2/2019 | Yaxley et al. | |
| D845,425 | S | | 4/2019 | Yaxley et al. | |

* cited by examiner

REVOLVER RELOADING DEVICE

CROSS-REFERENCE TO RELATED APPLICATIONS

This application claims the benefit of U.S. Provisional Application 62/955,094, filed on Dec. 30, 2019, which is hereby incorporated in its entirety by reference.

TECHNICAL FIELD

This disclosure relates to a reloading device for a revolver. Specifically, this disclosure relates to a reloading device that can be selectively reconfigured between flat and collapsed configurations.

BACKGROUND

To reload a revolver, a latch is often actuated to allow the cylinder of the revolver to swing out of one side of the frame, thereby exposing all of the chambers of the cylinder at the same time. Less commonly, some other revolvers reload through a break action wherein a latch is actuated to allow the barrel and cylinder to hinge relative to the frame, thereby exposing all of the chambers of the cylinder. Either design is compatible with many reloading devices, commonly referred to as "speedloaders" that allow loaded cartridges to be inserted into two or more chambers in a single motion. Speedloaders are often employed for competition or self-defense settings where the ability to reload quickly is important. Typically, speedloaders come in two varieties: flat and cylinderical.

Flat speedloaders, such as "speedstrips" are commonly made of a semi-soft and elastic plastic strip which holds all of the cartridges in a linearly oriented arrangement. This arrangement offers a low profile when carried, such as in a user's pocket. A user may take two cartridges and align them with two chambers of the cylinders to snap off two cartridges in a single motion. Revolvers cylinders commonly have anywhere from five to as many as ten or more chambers in the cylinder disposed in a circular pattern. Revolvers commonly employed for self-defense or competition typically have between five and eight chambers in the cylinder. Loading the cartridges two at a time can be faster than loading cartridges individually into each chamber; however, it still entails three distinct motions for a revolver having five or six chambers, and four distinct motions for a revolver having seven to eight chambers.

Alternatively, cylindrical speedloaders commonly hold the cartridges in a circular pattern sized complimentary to the circular pattern for the centers of the chambers in the revolver's cylinder. With this arrangement, the full number of cartridges necessary to reload the cylinder can be inserted into all of the chambers simultaneously, at which times the cartridges can all be released, such as by pushing a button or twisting a knob, to simultaneously load the chambers. These cylindrical speedloaders are typically faster to utilize than flat speedloaders; however, they have a higher profile/diameter which makes them inconvenient to carry in a pocket or belt pouch.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a revolver reloading device comprising a first wing assembly defining a first cartridge pocket and a second cartridge pocket, the first cartridge pocket defining a first center point, the second cartridge pocket defining a second center point; a second wing assembly defining a third cartridge pocket, the third cartridge pocket defining a third center point; and a center assembly hingedly coupled to the first wing assembly and the second wing assembly, the first wing assembly and the second wing assembly selectively rotatable relative to the center assembly about and between a flat configuration and a collapsed configuration, the first center point, the second center point, and the third center point being aligned in a linear arrangement in the flat configuration, the first center point, the second center point, and the third center point being aligned in a circular pattern in the collapsed configuration.

Also disclosed is a revolver reloading device comprising a lower external piece at least partially defining a cartridge pocket; and an internal constraint piece defining an inner lug, the internal constraint piece being rotatable relative to the lower external piece about and between a constraint position and a release position, the inner lug extending into the cartridge pocket in the constraint position, the inner lug being rotationally offset from the cartridge pocket in the release position.

Also disclosed is a method of using a revolver reloading device, the method comprising loading a first cartridge, a second cartridge, and a third cartridge into a first cartridge pocket, a second cartridge pocket, and a third cartridge pocket of the revolver reloading device, the revolver reloading device comprising a first wing assembly defining the first cartridge pocket and the second cartridge pocket, the first wing assembly comprising a first internal constraint piece rotatable about and between a constraint position and a release position; and a center assembly hingedly coupled to the first wing assembly, the center assembly defining a third cartridge pocket, the center assembly comprising a second internal constraint piece rotatable about and between the constraint position and the release position; repositioning the first internal constraint piece and the second internal constraint piece from the release position to the constraint position to secure the first cartridge, the second cartridge, and the third cartridge being secured in the revolver reloading device when the first internal constraint piece and the second internal constraint piece are in the constraint position; and folding the first wing assembly relative to the center assembly from a collapsed configuration to a flat configuration, the first cartridge pocket, the second cartridge pocket, and the third cartridge pocket being aligned in a linear arrangement in the flat configuration, the first cartridge pocket, the second cartridge pocket, and the third cartridge pocket being aligned in a circular pattern in the collapsed configuration.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
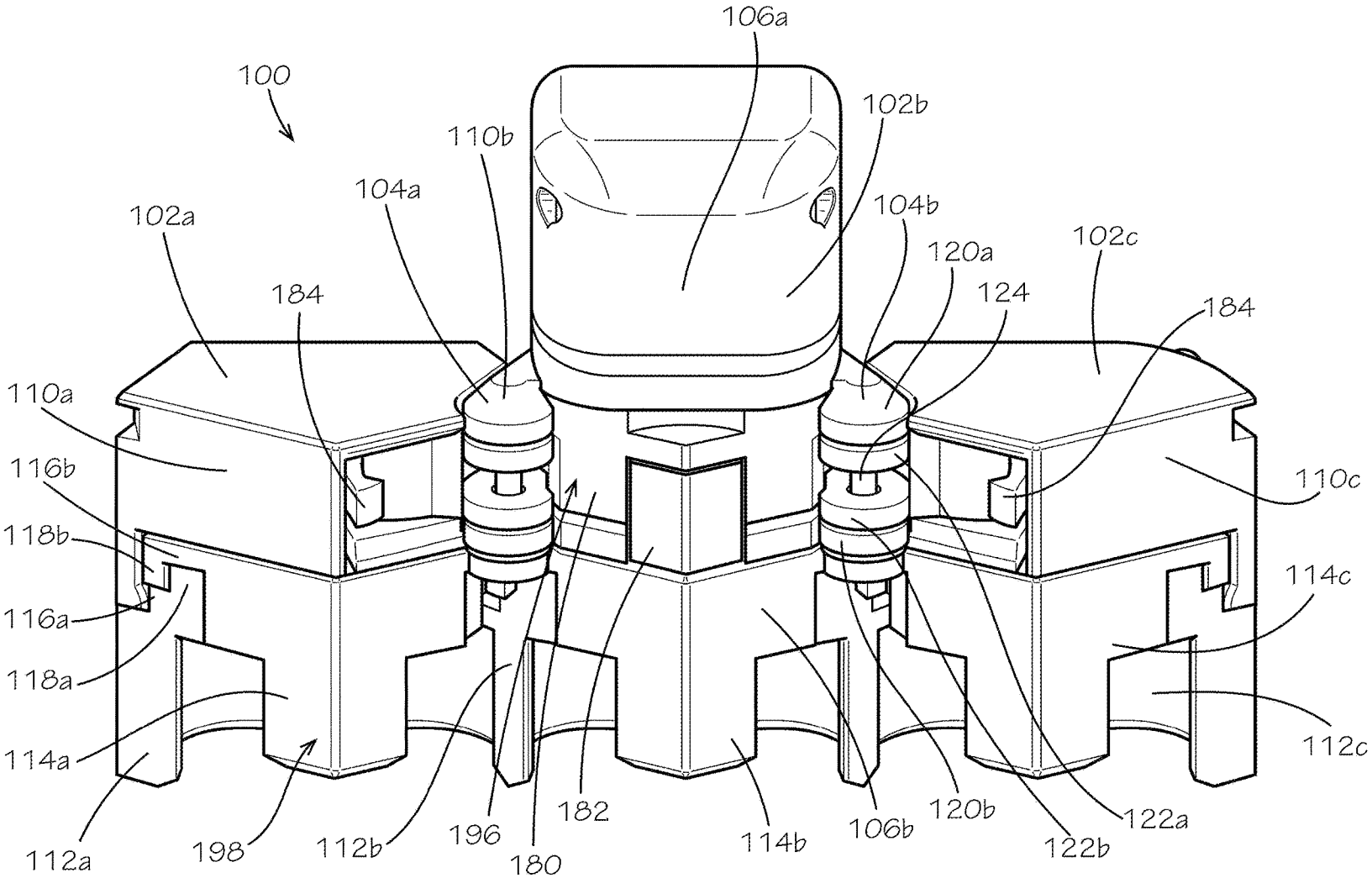
FIG. 1 is a front perspective top view of a revolver reloading device ("the device") comprising a left wing assembly, a center assembly, and a right wing assembly in a flat configuration in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a revolver reloading device and associated methods, systems, devices, and various apparatus. The revolver reloading device can comprise a left wing assembly, a center assembly, and a right wing assembly. It would be understood by one of skill in the art that the disclosed revolver reloading device is described in but a few exemplary aspects among many. No particular terminology or description should be considered limiting on the disclosure or the scope of any claims issuing therefrom.

Figure 7:
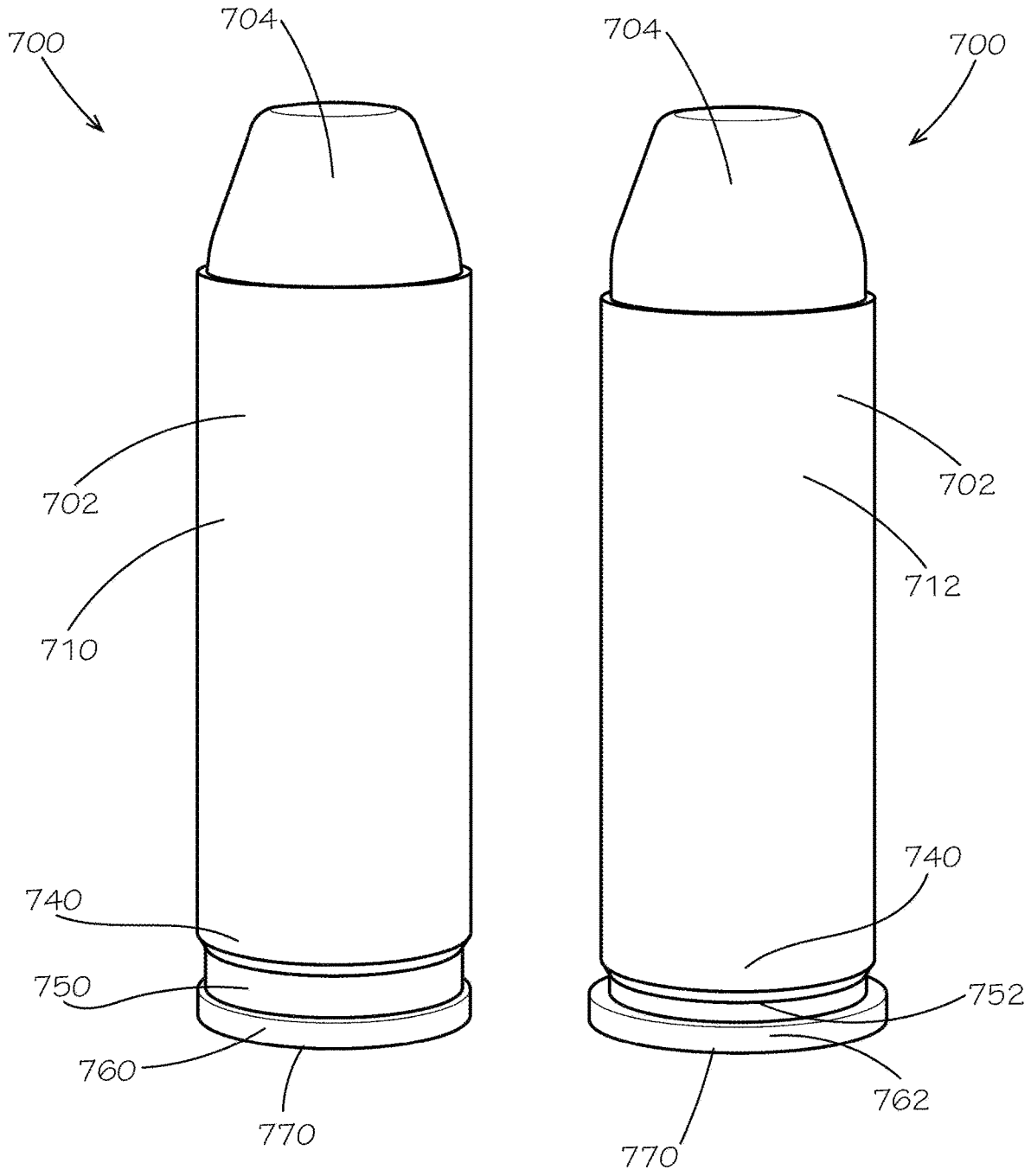
FIG. 7 is a perspective view of two conventional cartridges, including a rimless cartridge and a rimmed cartridge, shown for reference purposes.

FIG. 1 is a front perspective view of a revolver reloading device 100 (referred to hereafter as "the device 100") in a flat configuration. The device 100 can comprise a left wing assembly 102*a*, a center assembly 102*b*, and a right wing assembly 102*c*. The left wing assembly 102*a* can be hingedly coupled to the center assembly 102*b* by a left hinge 104*a*, and the right wing assembly 102*c* can be hingedly coupled to the center assembly 102*b* by a right hinge 104*b*. The left wing assembly 102*a* and the right wing assembly 102*c* can be selectively rotated about the respective hinges 104*a,b* between the flat configuration (shown) and a collapsed configuration (shown in FIGS. 3, 8, 9, 10, and 15-18). The selective rotation of the wing assemblies 102*a,c* relative to the center assembly 102*b* can be controlled by a pivot mechanism 196 of the device 100. The device 100 can comprise a constraint mechanism 198, which controls the retention and release of cartridges, such as exemplary cartridge 700 (shown in FIG. 7).

The center assembly 102*b* can comprise an upper module 106*a* and a lower module 106*b*. The upper module 106*a* can primarily house the pivot actuation mechanism 496 (shown in FIGS. 4, 5, and 16) and the constraint actuation mechanism 498 (shown in FIGS. 4, 14, and 16-18), which selectively operate the pivot mechanism 196 and the constraint mechanism 198, respectively. The wing assemblies 102*a,c* and the lower module 106*b* can house the primary components of the pivot mechanism 196 and the constraint mechanism 198.

The left wing assembly 102*a*, the lower module 106*b*, and the right wing assembly 102*c* can each respectively comprise a top external piece 110*a,b,c*, a lower external piece 112*a,b,c*, and an internal constraint piece 114*a,b,c*. During actuation of the constraint mechanism 198, the internal constraint pieces 114*a,b,c*, can rotate relative to the respective top external pieces 110*a,b,c* and respective lower external pieces 112*a,b,c*. As demonstrated by left wing assembly 102*a*, which can be representative of the lower module 106*b* and/or right wing assembly 102*c*, an upper end of each lower external piece 112*a,b,c* can define a lower groove 116*a* and a lower lip 118*a*. Near the upper end of the internal constraint pieces 114*a,b,c*, the internal constraint piece 114*a,b,c* can define an upper groove 116*b* and an upper lip 118*b*. The lower groove 116*a* can receive the upper lip 118*b*, and the upper groove 116*b* can receive the lower lip 118*a* so that these components can act as an interlocking track to control rotational movement of the internal constraint piece 114*a,b,c* relative to the respective top external pieces 110*a,b,c* and lower external pieces 112*a,b,c*. The top external pieces 110*a,b,c* can couple to the respective lower external pieces 112*a,b,c* to vertically capture the respective internal constraint pieces 114*a,b,c* between them.

As demonstrated by the right hinge 104*b*, which can be representative of the left hinge 104*a*, the top external piece 110*b* of the lower module 106*b* can define a top hinge ear 120*a* and a bottom hinge ear 120*b* that can interlock with two inner ears 122*a,b* defined by the respective adjacent wing assembly 102*a,c* (in this case, right wing assembly 102*c*). In the present aspect, the inner hinge ears 122*a,b* can be defined by the adjacent top external pieces 110*a,c* (in this case, top external piece 110*c*). Together, the ears 120*a,b*, 122*a,b* can capture a wing hinge pin 124, about which the wing assemblies 102*a,c* can rotate relative to the center assembly 102*b*. Additionally, each hinge 104*a,b*, can comprise a biasing element (not shown here for clarity) that rides each respective wing hinge pin 124 between the respective inner ears 122*a,b*. For example, the biasing element can be a torsion spring, similar to a torsion spring 1221 shown in FIG. 12. In such aspects, the wing hinge pins 124 can extend through a coiled portion of the torsion spring. The torsion springs can bias the wing assemblies 102*a,c* towards the collapsed configuration.

In other aspects, the biasing element can be a compliant mechanism or a different type of spring, such as a wound spring for example and without limitation. In aspects wherein the biasing element is a compliant mechanism, the device 100 may not comprise the hinges 104*a,b*. Instead, the compliant mechanisms may both control rotation of the wings assemblies 102*a,c* relative to the center assembly 102*b* and bias the wing assemblies 102*a,c* towards the collapsed configuration.

The pivot mechanism 196 can comprise the biasing elements, as well as a pivot lock 180 and a pivot lock stop 182. The pivot lock 180 can translate forward and rearward, between a locked position (shown) and an unlocked position (shown in FIG. 3). The pivot lock 180 can be in the locked position when it is translated fully rearward (into the page with respect to the present viewing angle). In the locked position, the pivot lock 180 can engage the inner ears 122*a,b* of the respective wing assemblies 102*a,c* to prevent the wing assemblies 102*a,c* from rotating about the wing hinge pins 124, under bias from the biasing elements, such as torsion springs, from the flat configuration to the collapsed configuration. The locked position is further shown and described below with respect to FIG. 2.

The pivot lock 180 and the pivot lock stop 182 can be captured between the top external piece 110*b* and the lower external piece 112*b*. The pivot lock stop 182 can limit the forward motion (out of the page with respect to the present viewing angle) of the pivot lock 180 to prevent it from slipping out from between the external pieces 110*b*,112*b*. When the pivot lock 180 is translated forward towards the pivot lock stop 182, the pivot lock 180 can be in the unlocked position. In the unlocked position, the pivot lock 180 does not interfere with the inner ears 122*a,b* of the respective wing assemblies 102*a,c*, which can allow the wing assemblies 102*a,c* to snap to the collapsed configuration by rotating about the respective wing hinge pins 124 under bias from the biasing elements, such as torsion springs. The top external pieces 110*a,c* of the respective wing assemblies 102*a,c* can each define a stopper leg 184 that can contact the pivot lock stop 182 to arrest the inward rotation and absorb the impacts of the wing assemblies 102*a,c* snapping to the collapsed configuration. The unlocked position is further shown and described below with respect to FIG. 3. In other aspects, such as the device 100 of FIG. 19, the wing assemblies 102*a,c* may not define the stopper legs 184.

Figure 2:
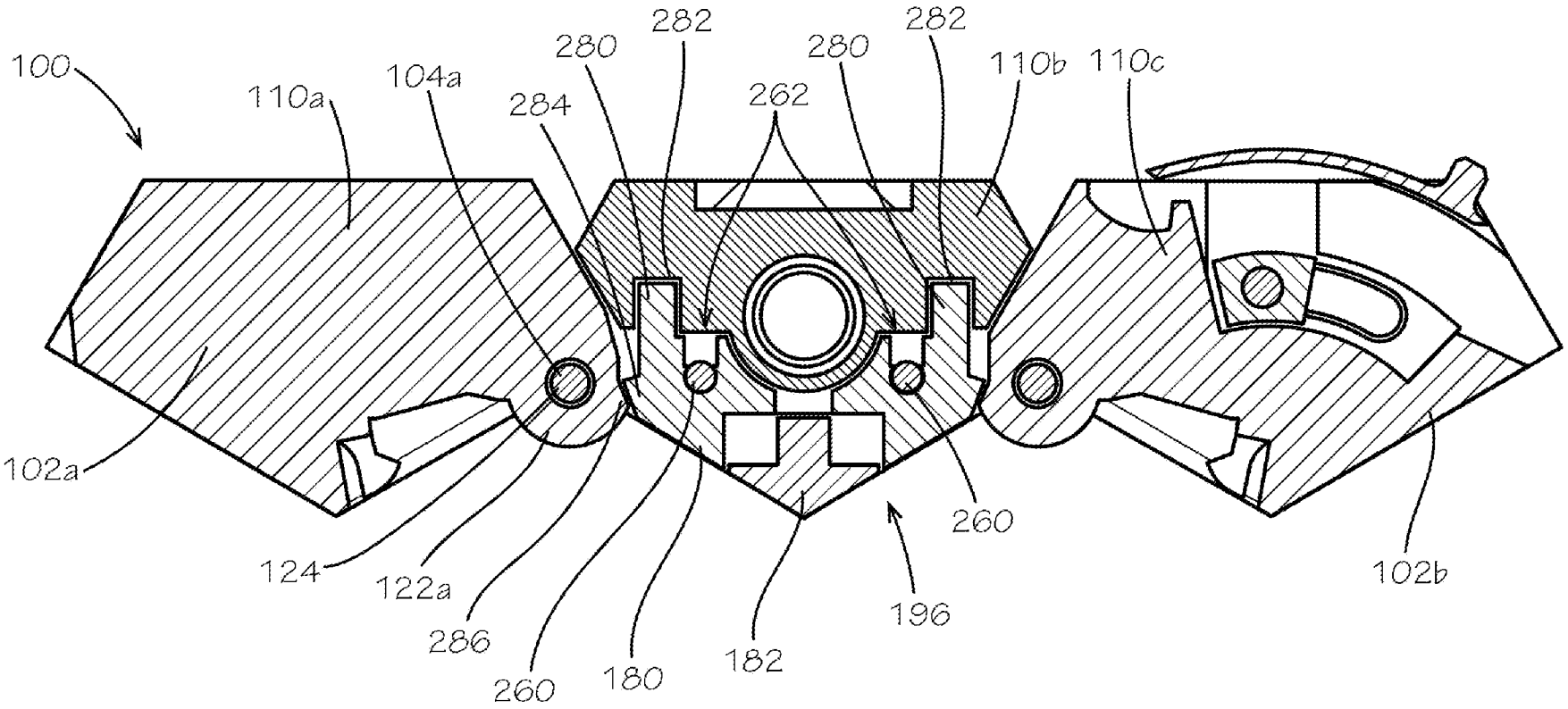
FIG. 2 is a cross-sectional top view of the device of FIG. 1 in the flat configuration, taken along viewing line 2-2 shown in FIG. 4.
Figure 4:
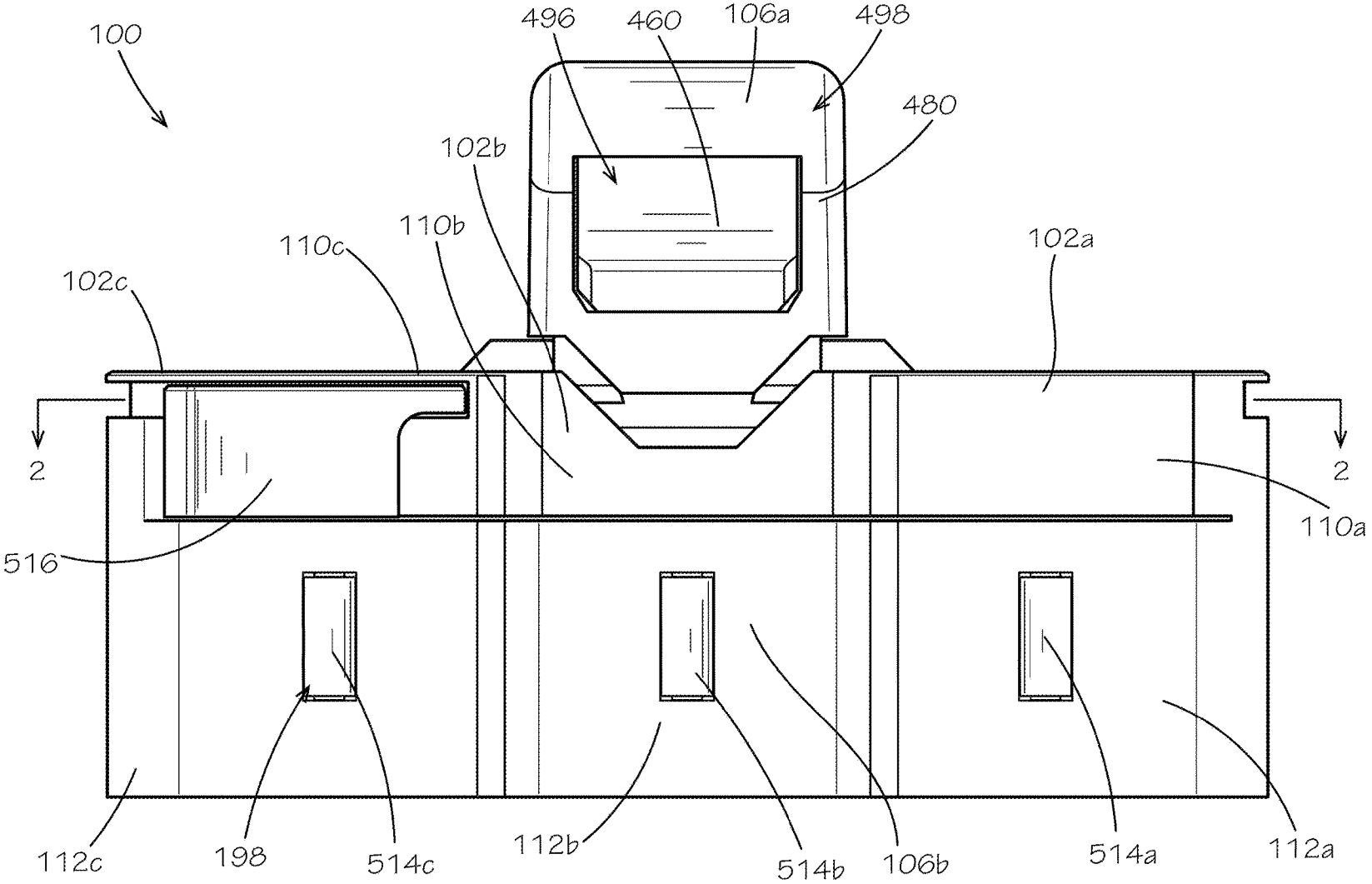
FIG. 4 is a rear view of the device of FIG. 1 in the flat configuration.

FIG. 2 is a cross-sectional top view of the device 100 in the flat configuration, taken along viewing line 2-2 as shown in FIG. 4. The pivot lock 180 of the pivot mechanism 196 is shown in the locked position. The pivot lock 180 can define a pair of stopping legs 280 that can be received by a pair of stopping pockets 282 defined by the top external piece 110*b*. When the stopping legs 280 are fully bottomed out, the pivot lock 180 can be in the locked position, wherein it cannot travel further rearward (upwards with respect to the present viewing angle). As demonstrated by the left hinge 104*a*, which can be representative of the right hinge 104*b* (shown in FIG. 1), the inner ears 122*a,b* (inner ear 122*b* shown in FIG. 1) can define ear locking flats 286 that can engage with pivot locking flats 284 when the pivot lock 180 is in the locked position. Engagement between the ear locking flats 286 and the pivot locking flats 284 can prevent motion of the wing assemblies 102*a,c* about the wing hinge pins 124 towards the collapsed position.

Figure 5:
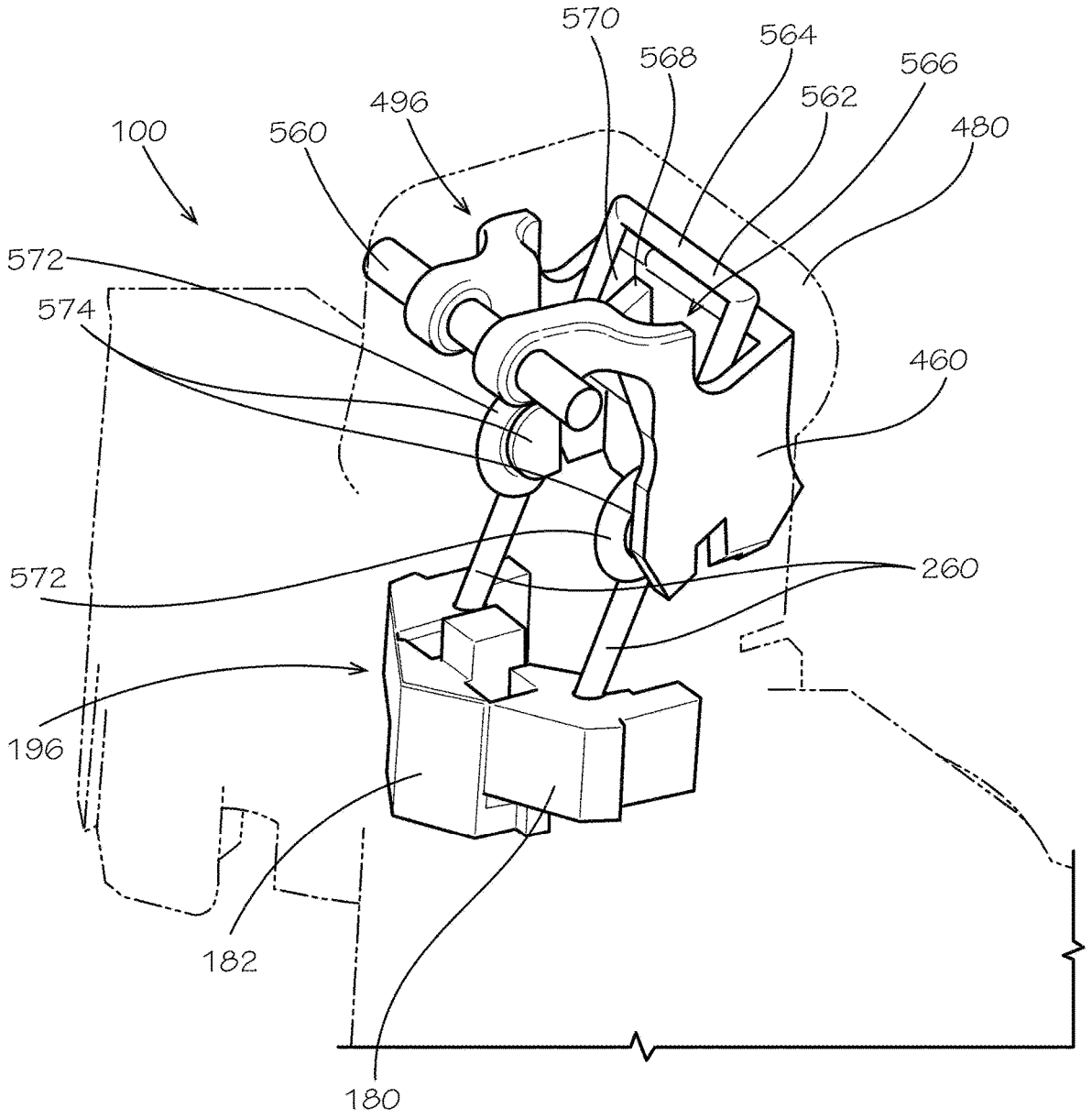
FIG. 5 is a partial transparency of the device of FIG. 1 in the flat configuration, showing portions of a pivot actuation mechanism and a pivot mechanism of the device in solid lines.
Figure 16:
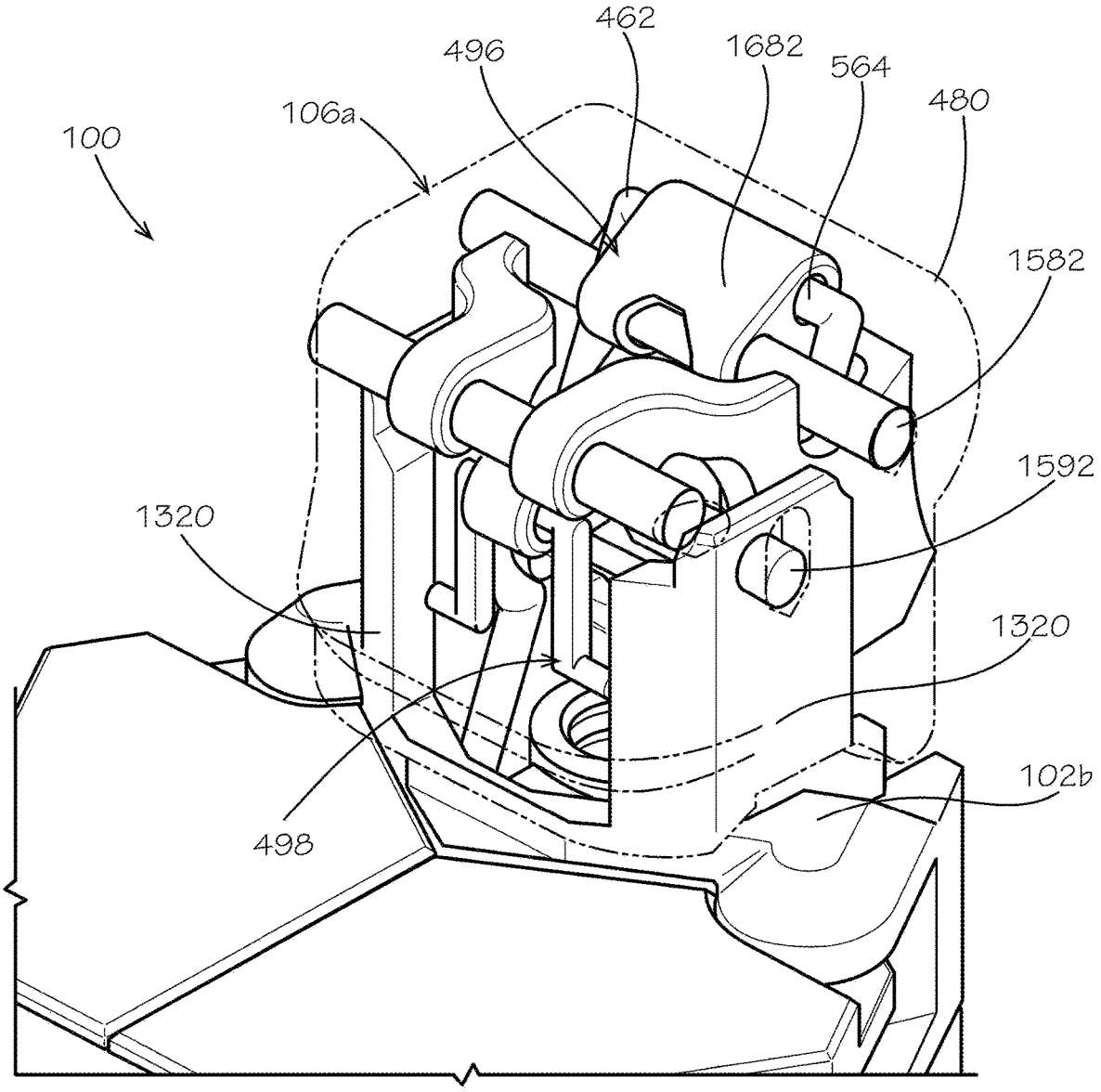
FIG. 16 is a detail view of an upper module of the center assembly of the device of FIG. 1 with the push cap shown in transparency, depicting a pivot actuation mechanism and a constraint actuation mechanism of the device.

The pivot lock 180 can define a pair of actuator pockets 262 that can receive legs 260 of an actuator linkage 562 (shown in FIG. 5) of the pivot actuation mechanism 496 (shown in FIGS. 4, 5, and 16). When the pivot actuation mechanism 496 is activated, the legs 260 can drive the pivot lock 180 forward (downward with respect to the present viewing angle) until the pivot lock 180 disengages the ear locking flats 286 from the pivot locking flats 284, thereby releasing the wing assemblies 102*a,c* to snap to the collapsed position under bias from the biasing elements, such as torsion springs.

Figure 3:
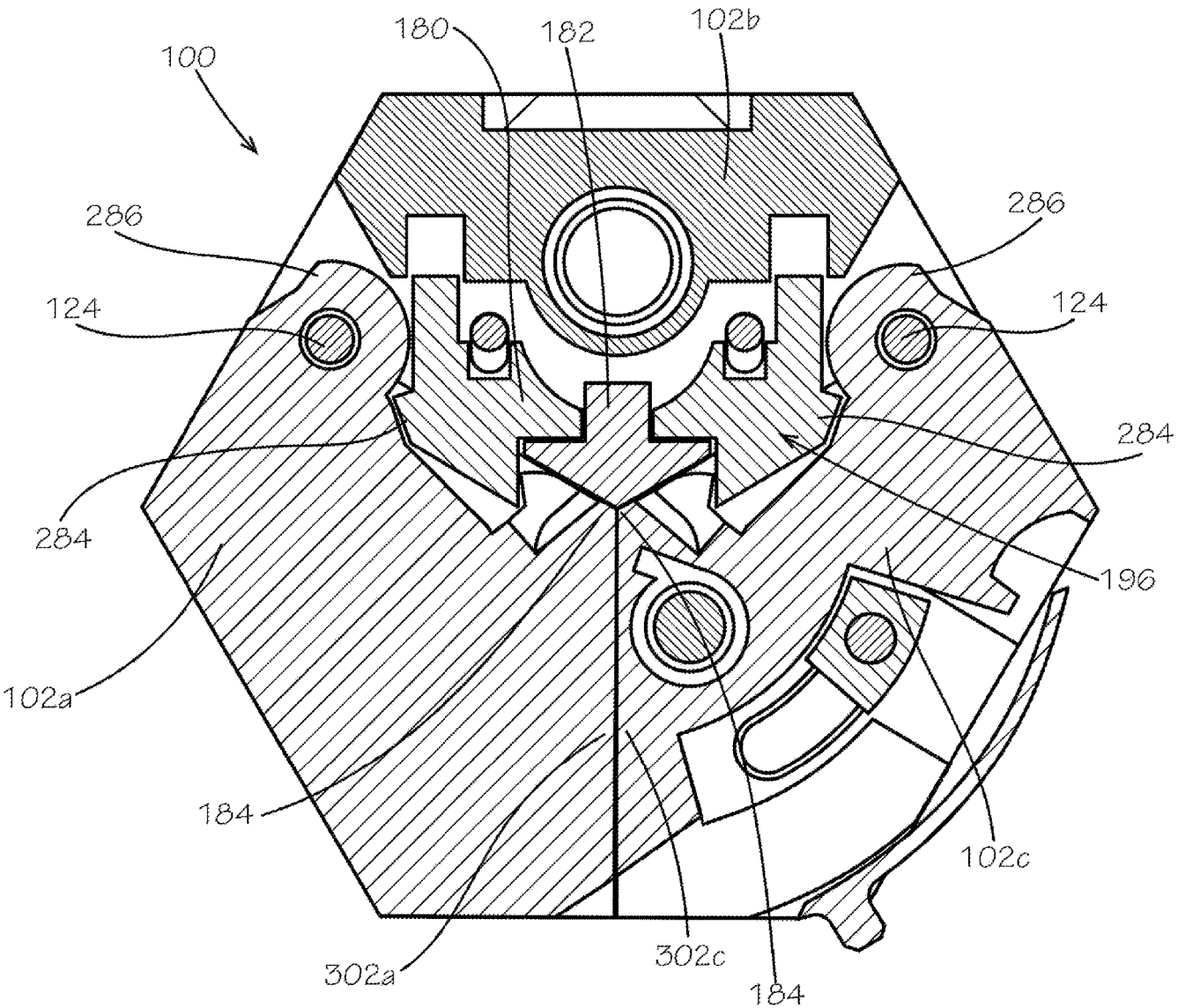
FIG. 3 is a cross-sectional top view of the device of FIG. 1 taken along viewing line 2-2, with the device shown in a collapsed configuration.

FIG. 3 is a cross-sectional top view of the device 100 taken along viewing line 2-2, but with the device 100 shown in the collapsed configuration. As previously described, when the pivot lock 180 of the pivot mechanism 196 is driven forwards towards the pivot lock stop 182 to the unlocked position, the pivot locking flats 284 and ear locking flats 286 can be disengaged. Disengagement of the pivot locking flats 284 and ear locking flats 286 can allow the wing assemblies 102*a,c* to rotate about the wing hinge pins 124 to the collapsed configuration shown here. Whether the pivot lock 180 actually contacts the pivot lock stop 182 in the unlocked position is not critical; rather, disengagement between the pivot locking flats 284 and ear locking flats 286 can control operation of the pivot mechanism 196.

The wing assemblies 102*a,c* can respectively define chamfered ends 302*a,b* that are shaped complimentary to one another to rest in facing engagement in the collapsed configuration. The stopper legs 184 can rest against the pivot lock stop 182 to ensure proper orientation of the wing assemblies 102*a,c*, and that the chamfered ends 302*a,b* meet evenly. In the present aspect, the chamfered ends 302*a,b* can be aligned substantially parallel to a front-to-back direction (top to bottom of the page with respect to the present viewing angle). Additionally, engagement between the stopper legs 184 and pivot lock stop 182 can partially absorb the impact of the wing assemblies 102*a,c* snapping to the collapsed position.

In the collapsed configuration, the device 100 can define a substantially hexagonal cross-section, corresponding to a six-round capacity of the present aspect. In some aspects, such as for a revolver with five chambers, the cross-section can be pentagonal, for example and without limitation. In some aspects, such as for a revolver with seven or eight chambers, the cross-section can be heptagonal or octagonal, respectively.

FIG. 4 is a rear view of the device 100 in the flat configuration. The upper module 106*a* can primarily house the pivot actuation mechanism 496 and the constraint actuation mechanism 498, which selectively operate the pivot mechanism 196 and the constraint mechanism 198, respectively. The upper module 106*a* can comprise a push cap 480, which can control the constraint actuation mechanism 498 (and thereby, activation of the constraint mechanism 198). The push cap 480 can also house numerous pins and linkage assemblies of the pivot actuation mechanism 496 and the constraint actuation mechanism 498. For example, a push actuator 460 of the pivot actuation mechanism 496 can be mounted to the push cap 480 by a push actuator pin 560 (shown in FIG. 5).

Depressing the push actuator 460 inwards into the push cap 480 can trigger the pivot actuation mechanism 496. Triggering the pivot actuation mechanism 496 can activate the pivot mechanism 196 (shown in FIGS. 3 and 4) to reconfigure the device 100 from the flat configuration to the collapsed configuration. Details related to the operation of the pivot actuation mechanism 496 are shown and discussed with respect to FIG. 5.

FIG. 5 is a partial transparency of the device 100, showing portions of the pivot actuation mechanism 496 and the pivot mechanism 196 in solid lines. An actuator linkage pin 1582 (shown in FIGS. 15 and 16) and an actuator linkage 1682 (shown in FIG. 16) is hidden from view in FIG. 5 for greater clarity.

The pivot actuation mechanism 496 can comprise the push actuator 460, the push actuator pin 560, the actuator linkage 462, the actuator linkage 1682, and the actuator linkage pin 1582. The push actuator 460 can be mounted within the push cap 480 (shown in transparency) by the push actuator pin 560, and the push actuator 460 can hinge relative to the push cap 480 about the push actuator pin 560.

The actuator linkage 562 can comprise a crossbar 564 connected to the legs 260 (shown previously in FIG. 2). The actuator linkage 562 can be positioned within a pocket 566 defined by the push actuator 460, and the legs 260 can lie in channels 570 defined by ribs 568 of the push actuator 460. As shown in FIG. 16, the actuator linkage 1682 can engage the crossbar 564 to connect the actuator linkage 562 to the push cap 480 via the actuator linkage pin 1582. The legs 260 can define arced portions 572 that can ride on trunnions 574 defined by the push actuator 460. As the push actuator 460 is depressed into the push cap 480 (towards the left with respect to the present viewing angle), the push actuator 460 can hinge relative to the push cap 480 about the push actuator pin 560, and the legs 260 can push the pivot lock 180 towards the pivot lock stop 182 to activate the pivot mechanism 196, as described above with respect to FIGS. 2 and 3.

Returning to FIG. 4, the wing assemblies 102*a,c* and the lower module 106*b* of the center assembly 102*b* can each respectively comprise a rear constraint 514*a,b,c* of the constraint mechanism 198. The rear constraints 514*a,b,c* can be positioned within the respective lower external pieces 112*a,b,c*. Attachment of the top external pieces 110*a,b,c* to the lower external pieces 112*a,b,c* can capture the rear constraints 514*a,b,c* within the respective wing assemblies 102*a,c* and the lower module 106*b* of the center assembly 102*b*. The rear constraints 514*a,b,c* can be rotatable relative to the top external pieces 110*a,b,c* and the lower external pieces 112*a,b,c*. In the present aspect, the rear constraints 514*a,b,c* can be partially exposed through the rear of the lower external pieces 112*a,b,c*, as shown. In other aspects, the lower external pieces 112*a,b,c* can fully enclose the rear constraints 514*a,b,c* on the rear side of the device 100.

The device 100 can comprise a reset tab 516. In the present aspect, the right wing assembly 102*c* can comprise the reset tab 516, and the reset tab 516 can be mounted to the top external piece 110*c*. In some aspects, the left wing assembly 102*a* can comprise the reset tab 516. The constraint mechanism 198 can comprise the reset tab 516, the rear constraints 514*a,b,c*, and the internal constraint pieces 114*a,b,c* (shown in FIG. 1). As further described in greater detail below, the rear constraints 514*a,b,c* and the internal constraint pieces 114*a,b,c* can rotate under spring load from a constraint position (shown in FIGS. 6, 8, and 10) to a release position (shown in FIG. 20) when the constraint actuation mechanism 498 is triggered. The reset tab 516 can be used to manually reset the rear constraints 514*a,b,c* and the internal constraint pieces 114*a,b,c* to the constraint position, such as by sliding the reset tab 516 away from the center assembly 102*b* (a clockwise direction when viewed from above).

Figure 6:
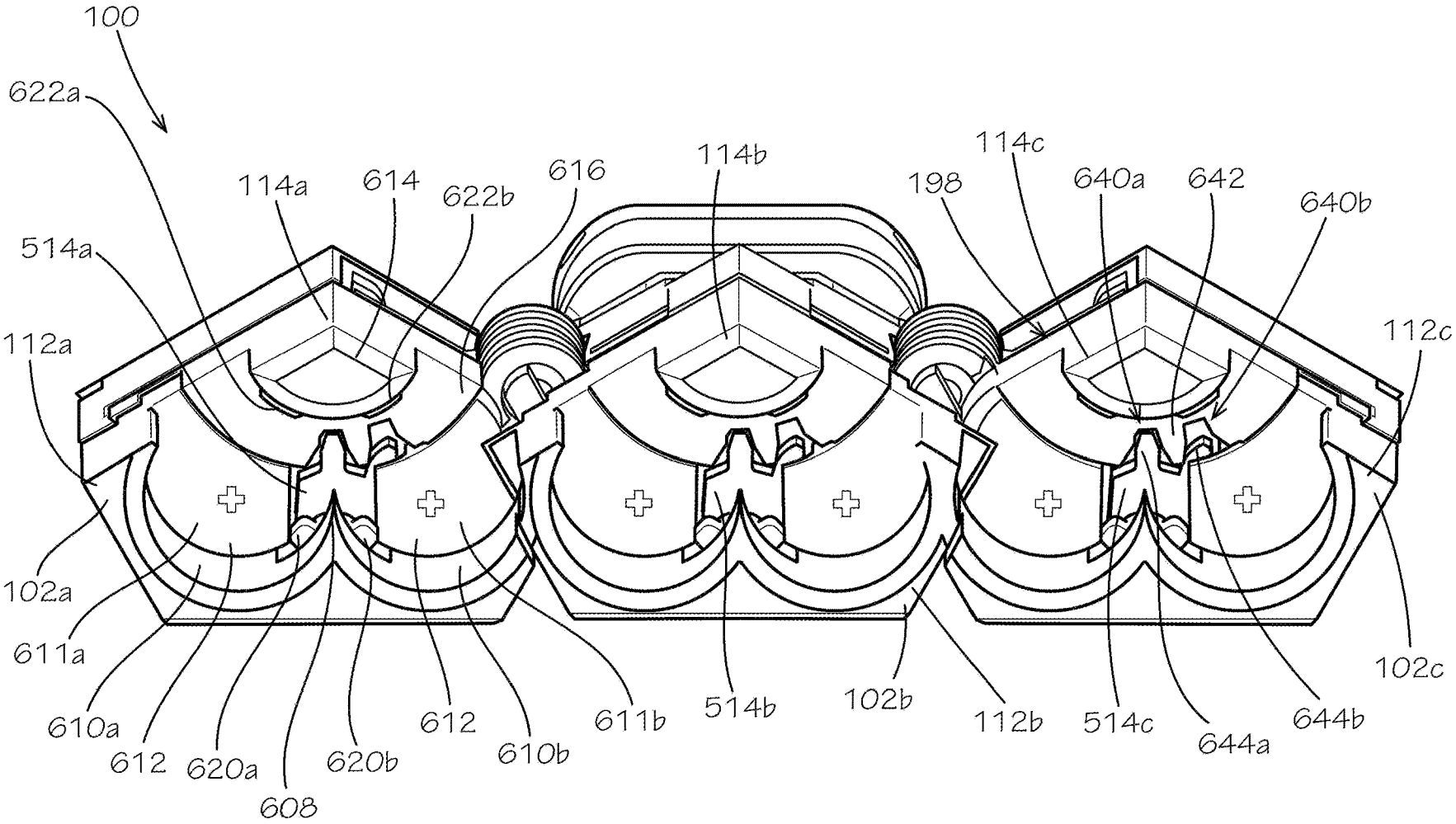
FIG. 6 is a bottom perspective view of the device of FIG. 1 in the flat configuration with a constraint mechanism of the device in a constraint position.

FIG. 6 is a bottom perspective view of the device 100 in the flat configuration with the constraint mechanism 198 in the constraint position. FIG. 6 is discussed below with reference to FIG. 7, which depicts two conventional cartridges 700, including a rimless cartridge 710 and a rimmed cartridge 712. Each cartridge 700 can comprise a case 702 and a bullet 704. For each case 702, a casehead 740 can define a rim 760,762, a groove 750,752, and a base 770 for the rimless cartridge 710 and the rimmed cartridge 712, respectively.

The primary distinction between the rimless cartridge 710 and the rimmed cartridge 712 is that a diameter of the rim 762 is greater than a diameter of the casehead 740 measured just above the groove 752 for the rimmed cartridge 712. Comparatively, a diameter of the rim 760 is equal to or less than (in the case of a rebated rim cartridge) a diameter of the casehead 740 measured just above the groove 750 for the rimless cartridge 710. Because the rim 762 of the rimmed cartridge 712 protrudes outwards, the rim 762 can be mechanically gripped, either for extraction from a revolver cylinder or for retention by the device 100. Because rimless cartridges 710 do not have a protruding rim 760, the groove 750 tends to be deeper and more elongated in a longitudinal direction compared to the groove 752 of the rimmed cartridge 712. The groove 750 can be grasped by an extractor for ejection or for retention by the device 100.

Rimmed cartridges 712 are more commonly used in revolvers; however, some revolvers, such as certain models produced by Charter Arms of Shelton, Conn., are produced that utilize rimless cartridges 710 without the use of retaining devices, such as moon clips. The device 100 can be configured to accommodate rimmed cartridges 712 and rimless cartridges 710, either in the same aspect or in different aspects of the device 100.

Turning back to FIG. 6, as demonstrated by the left wing assembly 102*a*, which can be representative of the right wing assembly 102*c* and center assembly 102*b*, the respective lower external pieces 112*a,b,c* can each define one or more scalloped walls 610*a,b*. Each scalloped wall 610*a,b* can at least partially define a cartridge pocket 611*a,b*, configured to receive the casehead 740 of the intended cartridge 700. Cartridges 700 come in a variety of different sizes/calibers, and dimensions and the shape of the device 100 can change according to the specifics of the cartridge caliber or calibers for which it is adapted.

Figure 20:
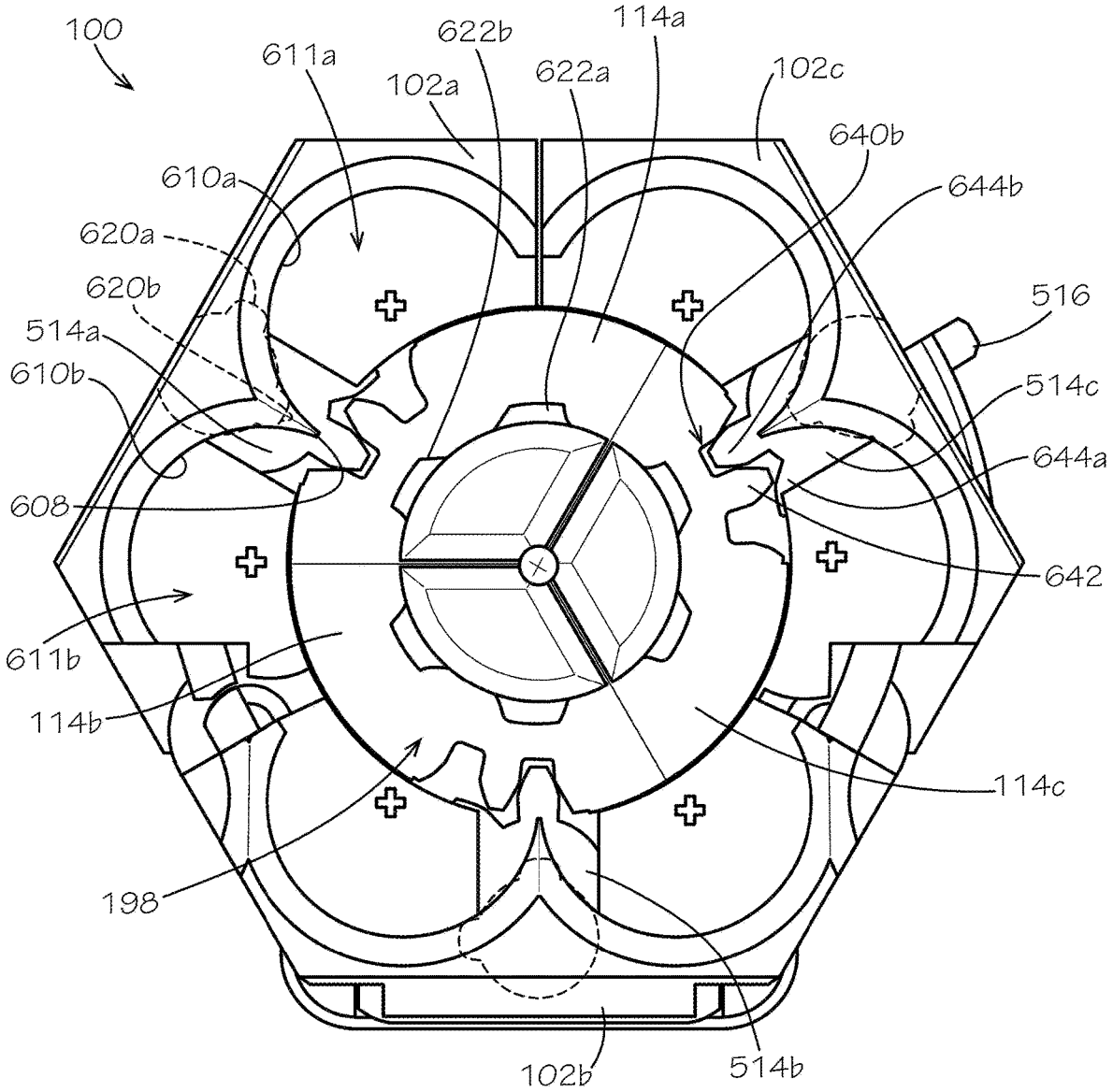
FIG. 20 is a bottom view of the device of FIG. 1 in the collapsed configuration with the constraint mechanism in a release position.

The scalloped walls 610*a,b* can be sized complimentary to the casehead 740 for the intended cartridge 700, with dimensions that provide support for the cartridge 700 without interfering with removal of the cartridges 700 from the device in the release configuration (shown in FIG. 20). For example, in an aspect of the device 100 configured for use with rimmed cartridges 712, the scalloped walls 610*a,b* can be sized to provide clearance for the rims 762 while still supporting the remainder of the case 702 to the greatest degree possible.

In the present aspect, each lower external piece 112*a,b,c*, can define two scalloped walls 610*a,b* and two cartridge pockets 611*a,b*, and the device 100 can be configured to carry six cartridges 700 for a revolver with a six-shot cylinder. In other aspects, the device 100 can hold greater or fewer than six cartridges 700. For example and without limitation, in an aspect where the device 100 carries five cartridges, one of the lower external pieces 112*a,b,c* can define a single scallop 610 and a single cartridge pocket 611.

The scalloped walls 610*a,b* can be substantially shaped as cylindrical segments. In cross-section, the scalloped walls 610*a,b* can each be substantially shaped as an arc of a circle with a center point (denoted by "+" symbol). The center points+can also be the center points for the cartridge pockets 611. In the present aspect, the center points+of all of the cartridge pockets 611 can be aligned in a linear arrangement for the flat configuration. However, this orientation should not be viewed as limiting for all aspects in the flat configuration. For example and without limitation, in an aspect of the device 100 providing seven cartridge pockets 611 for the retention of seven cartridges 700, each wing assembly 102*a,c* can define two cartridge pockets 611, and the center assembly 102*b* can define three cartridge pockets 611. In such an aspect, the center points+of the three cartridge pockets 611 of the center assembly 102*b* can be in a triangular pattern while the center points+of the four cartridge pockets 611 defined together by the wing assemblies 102*a,c* can be in the linear arrangement. In such an aspect, two of the center points+of the cartridge pockets 611 of the center assembly 102*b* can be aligned in the linear arrangement with the center points+of the four cartridge pockets 611 defined together by the wing assemblies 102*a,c*.

In some aspects, such as an aspect of the device 100 defining eight cartridge pockets 611 for the retention of eight cartridges 700, the center assembly 102*b* can define two cartridge pockets 611 while each wing assembly 102*a,c*, can define three cartridge pockets 611. In such aspects, the center points+of the cartridge pockets 611 for each wing assembly 102*a,c* can be positioned in a triangular configuration. The center points+of the six innermost cartridge pockets 611 can be in the linear arrangement while the center points+of the two outermost cartridge pockets 611 (furthest from center assembly 102*b*) can be offset from the linear arrangement. In each of the aspects described, at least three or more of the center points+of the cartridge pockets 611 can be in the linear arrangement in the flat configuration.

As further demonstrated by the left wing assembly 102*a*, which can be representative of the right wing assembly 102*c* and center assembly 102*b*, the lower external pieces 112*a, b,c*, can each define a platform portion 612 intersecting with each respective scalloped wall 610*a,b*. The scalloped walls 610*a,b* can be substantially perpendicular to a central axis (not shown) for each scalloped wall 610*a,b*, extending through the respective center points+from the top of the device 100 to the bottom of the device 100.

As demonstrated by the internal constraint piece 114*a* of the left wing assembly 102*a*, which can be representative of each internal constraint piece 114*a,b,c*, the internal constraint pieces 114*a,b,c* can each define a center post segment 614 and a platform portion 616. The center post segment 614 can extend downwards from the platform portion 616 (outwards from the page with respect to the present viewing angle), substantially perpendicular to the platform portion 616. The platform portion 616 can be substantially coplanar with the platform portions 612 of the lower external pieces 112*a,b,c*. Together, the platform portions 612,616 can provide a flat surface for supporting the base 770 of the cartridge 700 positioned within each cartridge pocket 611*a, b*.

In the present aspect, the constraint mechanism 198 can be in the constraint position. As further demonstrated by the right wing assembly 102*c*, which can be representative of the left wing assembly 102*a* and center assembly 102*b*, the platform portions 616 of the internal constraint pieces 114*a, b,c* can each define a constraint position notch 640*a* and a release position notch 640*b*, separated by an internal tooth 642. The rear constraints 514*a,b,c*, can each define a constraint tooth 644*a* and a release tooth 644*b*. The constraint tooth 644*a* and the release tooth 644*b* can be meshed with the internal tooth 642 such that rotation of the internal constraint pieces 114*a,b,c*, controls rotation of the respective meshed rear constraints 514*a,b,c*. When the constraint tooth 644*a* is fully engaged with the constraint position notch 640*a*, the constraint mechanism 198 can be in the constraint position, as shown. When the release tooth 644*b* is fully engaged with the release position notch 640*b*, the constraint mechanism 198 can be in the release position (shown in FIG. 20).

As further demonstrated by the left wing assembly 102*a*, which can be representative of the right wing assembly 102*c* and center assembly 102*b*, the rear constraints 514*a,b,c* can each define a first outer lug 620*a* and a second outer lug 620*b*. Similarly, the center post segments 614 can each define a first inner lug 622*a* and a second inner lug 622*b*. In the constraint position the outer lugs 620*a,b* can extend outwards from the scalloped walls 610*a,b* towards the center points++of the cartridge pockets 611*a,b*. Specifically, the first outer lug can 620*a* extend outwards from scalloped wall 610*a* into cartridge pocket 611*a*, and the second outer lug 620*b* can extend outwards from scalloped wall 610*b* into cartridge pocket 611*b*. Similarly, the inner lugs 622*a,b* can be aligned towards the center points+of the cartridge pockets 611*a,b* in the constraint position, with the first inner lug 622*a* extending into cartridge pocket 611*a* and the second inner lug 622*b* extending into cartridge pocket 611*b*.

With the cartridges 700 positioned within cartridge pocket 611*a,b*, the outer lugs 620*a,b* and the inner lugs 622*a,b* can cooperate to constrain the adjacent cartridge 700. For aspects of the device 100 configured for use with the rimless cartridge 710, the lugs 620*a,b*,622*a,b* can protrude into the groove 750 to constrain the rimless cartridge 710 in the constraint position. For aspects of the device 100 configured for use with the rimmed cartridge 712, the lugs 620*a,b*, 622*a,b* can slip over the rim 762 to secure the base 770 against the platform portions 612,616 in the constraint position. In aspects configured for use with the rimmed cartridges 712, the lugs 620*a,b*,622*a,b* may or may not engage the groove 752 of the rimmed cartridge 712.

The constraint mechanism 198 can be held in the constraint position by the constraint actuation mechanism 498 (shown in FIGS. 4, 14, and 16-18), and triggering the constraint actuation mechanism 498 can cause the constraint mechanism 198 to rotate to the release position (shown in FIG. 20) under spring bias while the device 100 is in the collapsed configuration (shown in FIGS. 3, 8, 9, 10, and 15-18). In doing so, the internal constraint pieces 114*a,b,c* can rotate clockwise when viewed from below, and the rear constraints 514*a,b,c* can rotate opposite from the internal constraint pieces 114*a,b,c* (counterclockwise when viewed from below) due to the meshing of the teeth 642,644*a,b*.

In the release position (shown in FIG. 20), the first outer lug 620*a* (shown in transparency in FIG. 20) can rotate into scalloped wall 610*a* so that it does not protrude into cartridge pocket 611*a*. The second outer lug 620*b* (shown in transparency in FIG. 20) can rotate under an intersecting point 608 defined between the adjacent scalloped walls 610*a,b*, so that it does not substantially protrude from either scalloped wall 610*a,b* into the adjacent cartridge pockets 611*a,b*. In the release position, the inner lugs 622*a,b* can be misaligned from the center points+of cartridge pockets 611*a,b*, such as by being rotationally offset from the respective cartridge pockets 611*a,b*. The second inner lug 622*b* can rotate to point towards the intersecting point 608, and the first inner lug 622*a* can be realigned to the left (with respect to the present viewing angle of FIG. 6; clockwise with respect to the viewing angle of FIG. 20) and away from the center point+of cartridge pocket 611*a*. By realigning the lugs 620*a,b*,622*a,b* in the release position, a cartridge 700 positioned within each respective cartridge pocket 611*a,b* can be freed by disengaging the lugs 620*a,b*,622*a,b* from the groove 750,752 and/or rim 760,762 of the respective cartridge 700.

Figure 8:
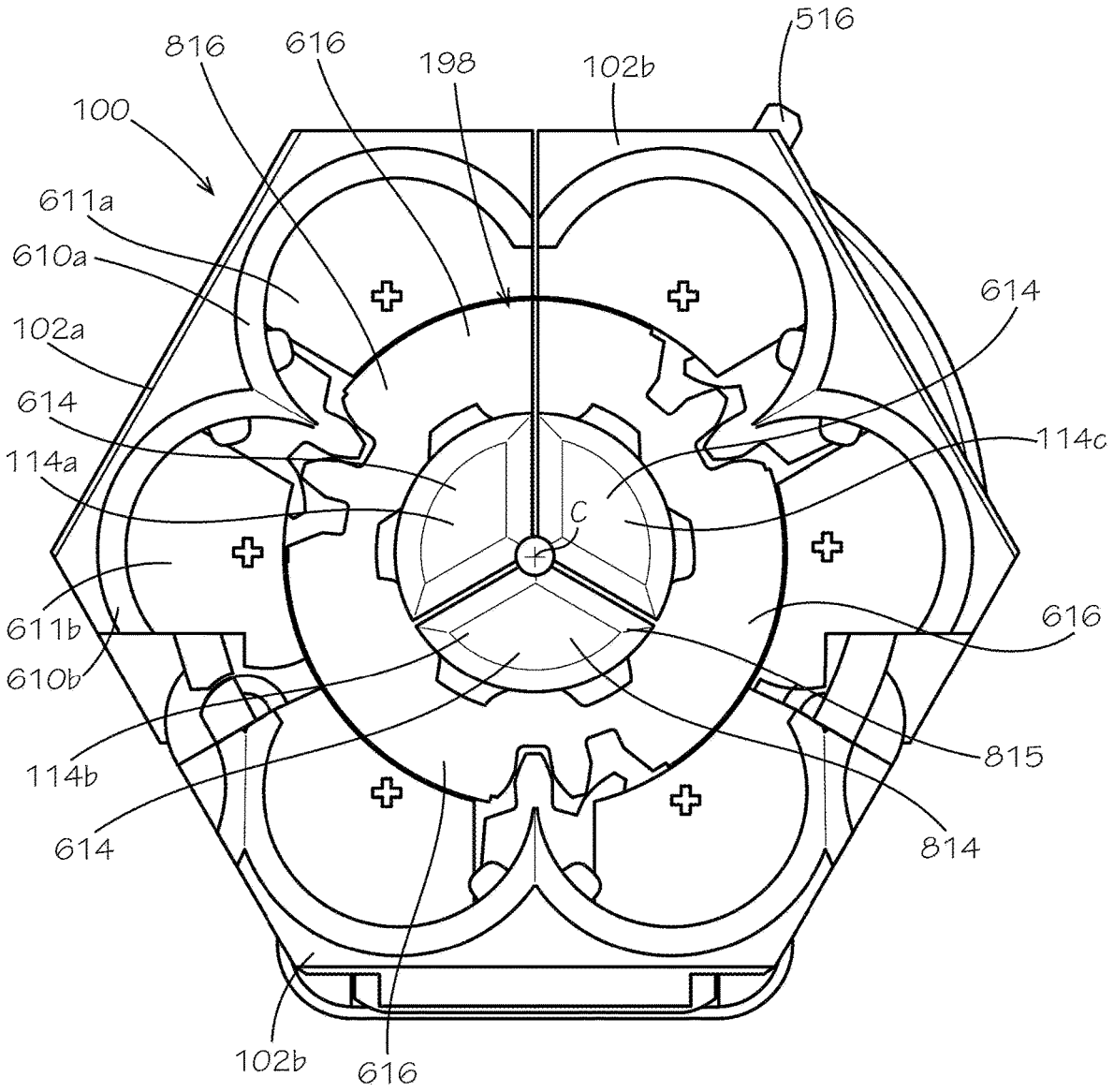
FIG. 8 is a bottom view of the device of FIG. 1 in the collapsed configuration with the constraint mechanism in the constraint position.

FIG. 8 is a bottom view of the device 100 in the collapsed configuration with the constraint mechanism 198 in the constraint position. In the collapsed configuration, the center points+of the cartridge pockets 611*a,b* (represented here by the left wing assembly 102*a*) can lie in a circular pattern around a center axis C. A diameter of the circular pattern can be sized complementary to the spacing of chamber centers within a revolver cylinder for which the device 100 is compatible. In the collapsed configuration, no linear line can pass through more than two center points+of any of the cartridge pockets 611 at a time.

In the collapsed configuration, the left wing assembly 102*a*, center assembly 102*b*, and right wing assembly 102*c* can fold so that the internal constraint pieces 114*a,b,c* can be positioned together to form a constraint spindle 814. The constraint spindle 814 can comprise a center post 815 formed by the center post segments 614, which can be substantially cylindrical with the exception of the inner lugs 622*a,b* (shown in FIG. 6). The intersection of the three center post segments 614 can define the center axis C, which can be the axis of rotation for the constraint spindle 814. The platform portions 616 can form a platform rim 816, which can extend radially outwards from the center post 815 relative to the center axis C. The platform rim 816 can be substantially circular, with the exception of the constraint position notches 640*a*, release position notches 640*b*, and internal teeth 642 (each shown in FIG. 6).

In the collapsed configuration, the constraint mechanism 198 is capable of rotating from the constraint position to the release position under spring force when the constraint actuation mechanism 498 (shown in FIGS. 4, 14, and 16-18) is triggered. Rotation of the constraint mechanism 198 can also rotate the reset tab 516 in the same rotational direction as the constraint spindle 814 (towards the center assembly 102*b* in the present aspect). In some aspects, the reset tab 516 may not rotate with the constraint spindle 814 when the constraint mechanism 198 repositions from the constraint position to the release position.

The constraint mechanism 198 can be reset by rotating the reset tab 516 away from the center assembly 102*b*, which can directly rotate the constraint spindle 814 in the same rotational direction back to the constraint position and indirectly rotate the rear constraints 514*a,b,c* (shown in FIG. 6) in the opposite direction to the constraint position via meshing of the teeth 642,644*a,b* (shown in FIG. 6).

Figure 9:
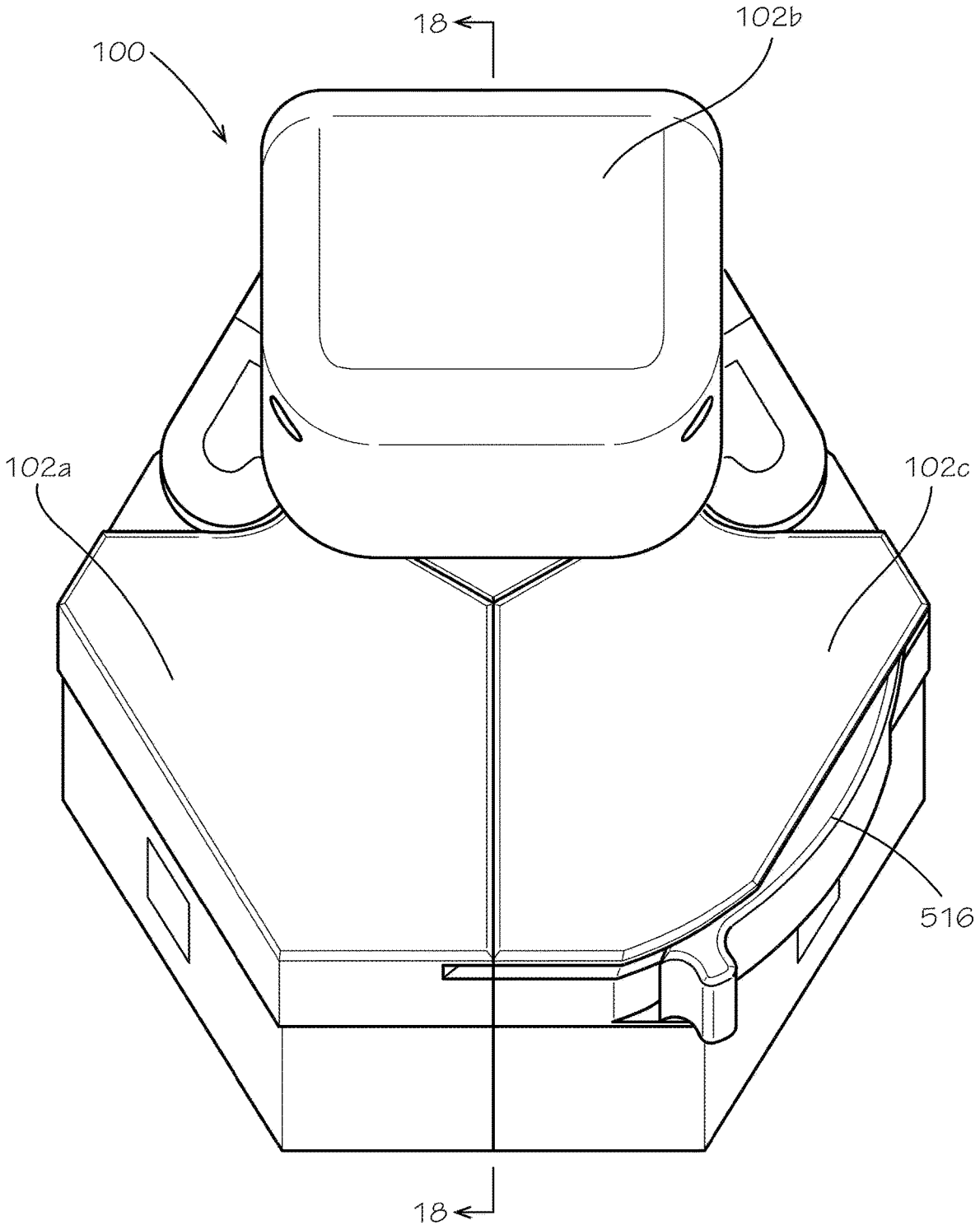
FIG. 9 is a top perspective view of the device of FIG. 1 in the collapsed configuration.
Figure 10:
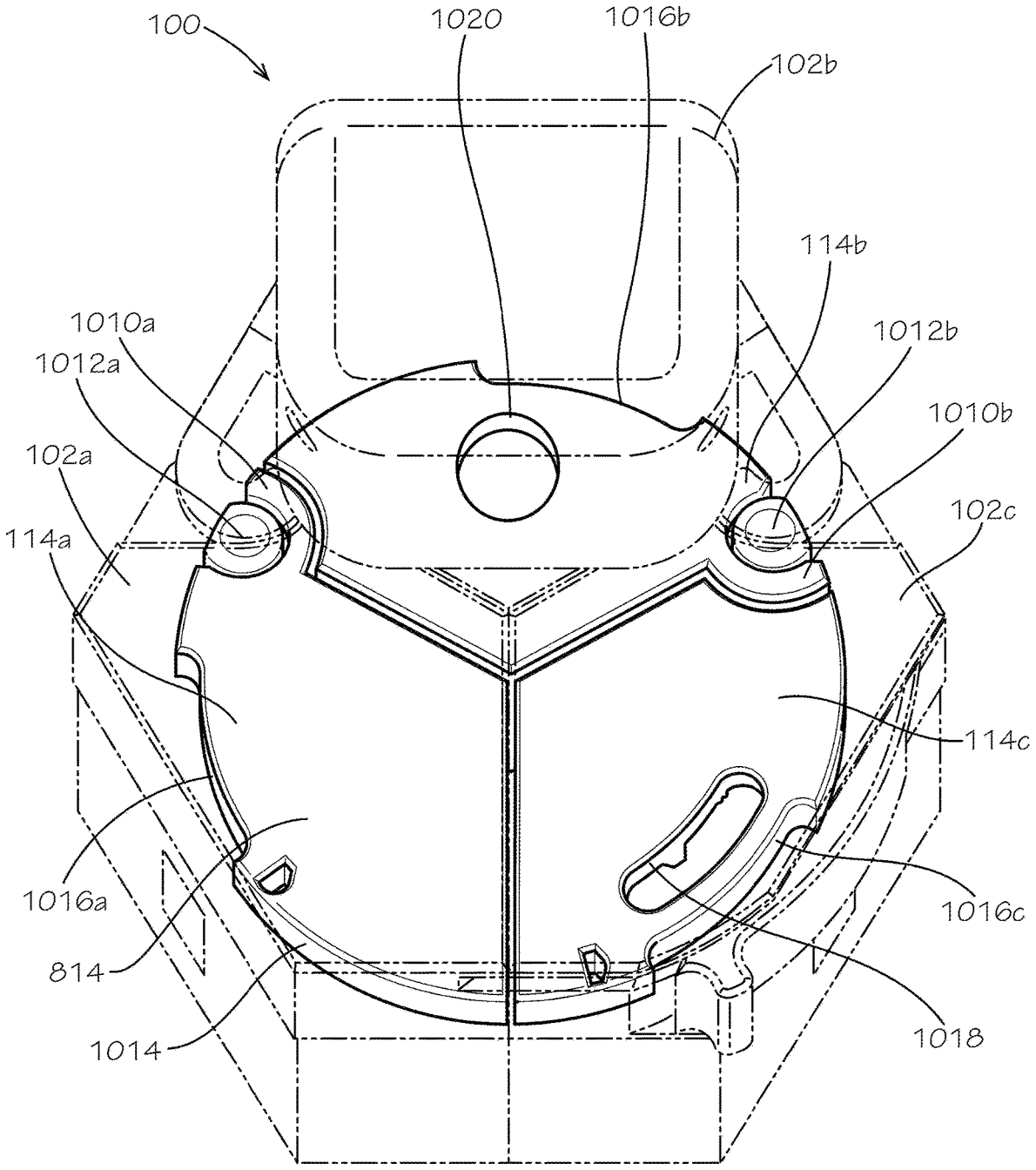
FIG. 10 is a top perspective view of the device of FIG. 1, shown in partial transparency, depicting the internal constraint pieces of the left wing assembly, center assembly, and right wing assembly.

FIG. 9 is a top perspective view of the device 100 in the collapsed configuration. FIG. 10 is a partially transparent view from the same perspective demonstrating the interlinking of the internal constraint pieces 114*a,b,c*. Internal constraint piece 114*a* can define a left hinge arm 1010*a*, which can engage a center hinge post 1012*a* defined by internal constraint piece 114*b*. At the opposite end of internal constraint piece 114*b* from the center hinge post 1012, the internal constraint piece 114*b* can define a center hinge arm 1010*b*, which can engage a right hinge post 1012*b* defined by the internal constraint piece 114*c*. Interlinking of the hinge arms 1010*a,b* and hinge posts 1012*a,b* can ensure that the internal constraint pieces 114*a,b,c* rotate together about and between the constraint position and release position as the single constraint spindle 814. Additionally, when the constraint spindle 814 is in the constraint position, the hinge arms 1010*a,b* and hinge posts 1012*a,b* can align with the hinges 104*a,b* (shown in FIG. 1) to facilitate reconfiguration of the device 100 from the collapsed configuration to the flat configuration.

The constraint spindle 814 can define an outer circumferential surface 1014. The outer circumferential surface 1014 can define a first notch 1016*a*, defined by internal constraint piece 114*a*, a second notch 1016*b*, defined by internal constraint piece 114*b*, and a third notch 1016*c*, defined by internal constraint piece 114*c*. These notches 1016*a,b,c*, can engage with a plurality of external pins 1114*b,c* (shown in FIGS. 11-13; external pin of the left wing assembly 102*a* not shown) to limit rotation of the constraint spindle 814.

The internal constraint piece 114*c* can define a reset slot 1018. The reset slot 1018 can be engaged by a reset pin 1116 (shown in FIG. 11) that can extend between the reset slot 1018 and the reset tab 516 (shown in FIG. 9) so that rotation of the reset tab 516 can rotate the constraint spindle 814 from the release position back to the constraint position. In the present aspect, the reset slot 1018 can be elongated and can allow the constraint spindle 814 to rotate relative to the reset tab 516, such as from the constraint position to the release position. In aspects wherein the reset tab 516 rotates with the constraint spindle 814 from the constraint position to the release position, the reset slot 1018 can be a hole rather than an elongated slot.

Figure 11:
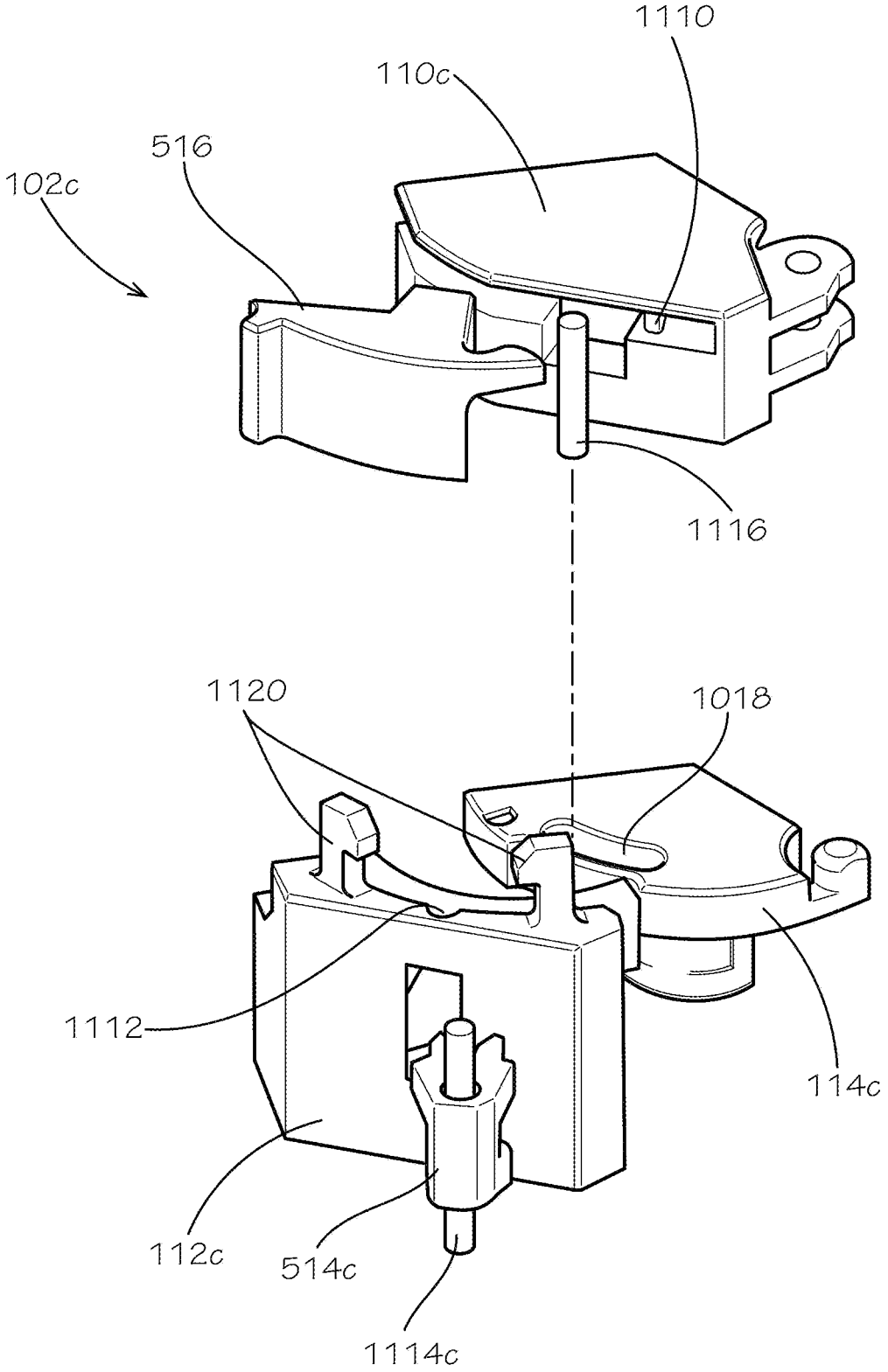
FIG. 11 is an exploded rear view of the right wing assembly of the device of FIG. 1.
Figure 12:
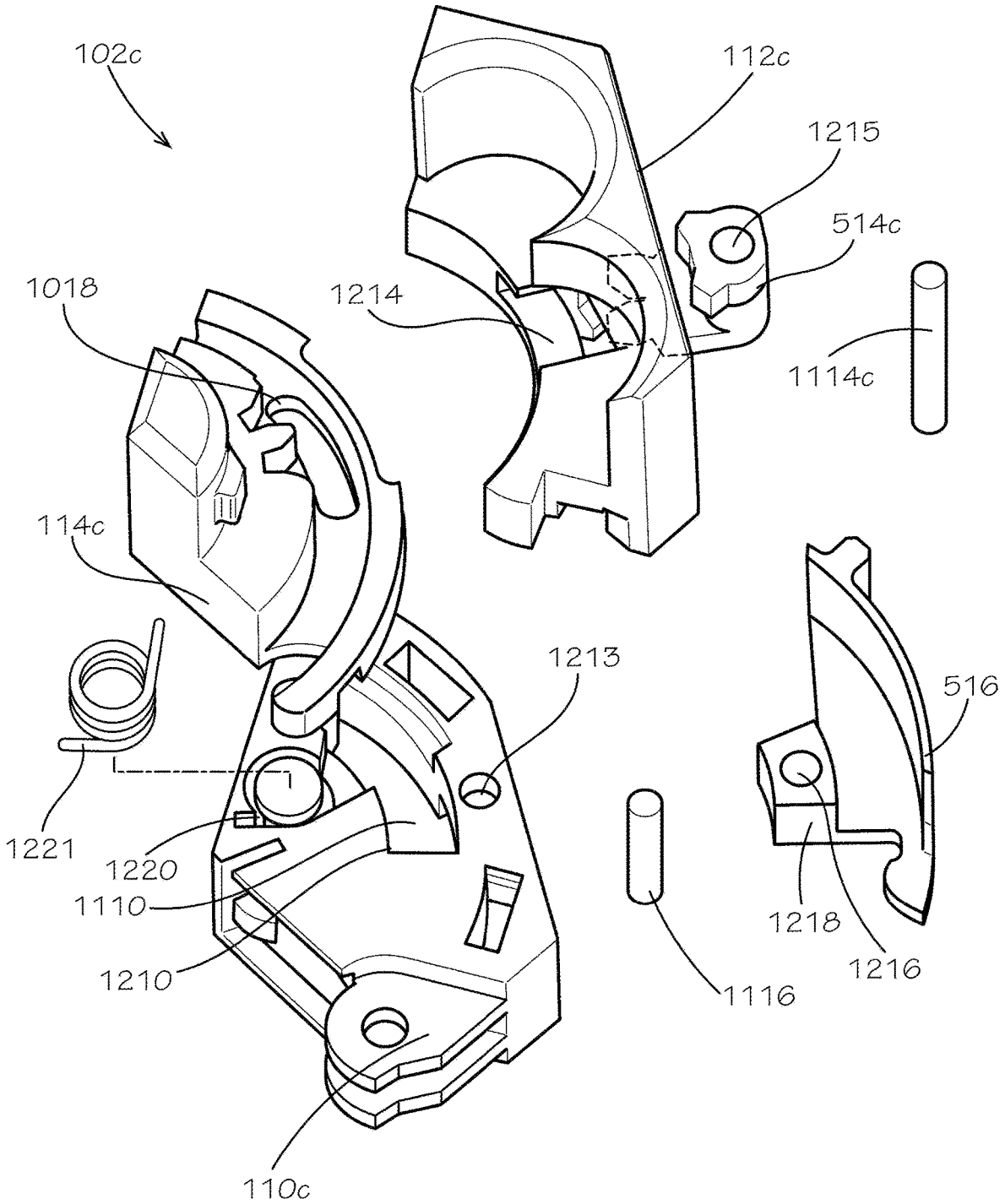
FIG. 12 is an exploded bottom view of the right wing assembly of the device of FIG. 1.

The internal constraint piece 114*b* can define a pin hole 1020, which can engage a spring pin 1410 (shown in FIG. 14) of the constraint actuation mechanism 498 (shown in FIGS. 4, 14, and 16-18) to hold the constraint spindle 814 in the constraint position while resisting a spring force biasing the constraint spindle 814 towards the release position, as further described with respect to FIGS. 11 and 12.

FIG. 11 is an exploded rear view of the right wing assembly 102*c*. The lower external piece 112*c* can define a rear pin hole 1112 extending substantially vertically. The rear pin hole 1112 can receive external pin 1114*c*, which the rear constraint 514*c* can ride upon and rotate about.

At the top end of the lower external piece 112*c*, two snap hooks 1120 can be defined. The snap hooks 1120 can engage the top external piece 110*c* to secure the top external piece 110*c* to the lower external piece 112*c*, thereby capturing the rear constraint 514*c*, external pin 1114*c*, and internal constraint piece 114*c* between them (as discussed above with respect FIG. 1 for internal constraint piece 114*c*). These features can be representative of the assembly of the left wing assembly 102*a* and lower module 106*b* of the center assembly 102*b*.

The top external piece 110*c* can define a reset tab window 1110, which can receive the reset tab 516 and define a track for its rotational travel. The reset pin 1116 can extend from the reset tab 516 to the reset groove 1018 as previously described, and further described below with respect to FIG. 12.

FIG. 12 is an exploded bottom view of the right wing assembly 102*c*. The reset tab 516 can define a boss 1218, which can be inserted into the reset tab window 1110 of the top external piece 110*c*, and the boss 1218 can ride in a track 1210 defined by the top external piece 110*c*. The boss 1218 can define a reset pin hole 1216 which can receive the reset pin 1116. The reset pin 1116 can then be received by the reset slot 1018 of the internal constraint piece 114*c* when the internal constraint piece 114*c* is captured between the top external piece 110*c* and the lower external piece 112*c*. The top external piece 110*c* can also define a torsion spring slot 1220 adjacent to the reset tab window 1110 configured to receive a biasing element, such as the torsion spring 1221. A leg of the torsion spring 1221 can contact either the boss 1218 or the reset pin 1116. Through the connection between the reset tab 516 and the internal constraint piece 114*c* via the reset pin 1116, the torsion spring acting on the reset pin 1116 or the boss 1218 can bias the internal constraint piece 114*c*, and indirectly the constraint spindle 814 (shown in FIG. 8) towards the release position. In other aspects, the biasing element can be a compliant mechanism or a different type of spring, such as a wound spring for example and without limitation.

Also shown, the lower external piece 112*c* can define a window 1214 for receiving the rear constraint 514*c* when the rear constraint 514*c* is pinned in place through a pin hole 1215 in the rear constraint 514*c* by the external pin 1114*c*. The external pin 1114*c* can then be captured by a top pin hole 1213 defined by the top external piece 110*c*.

Figure 13:
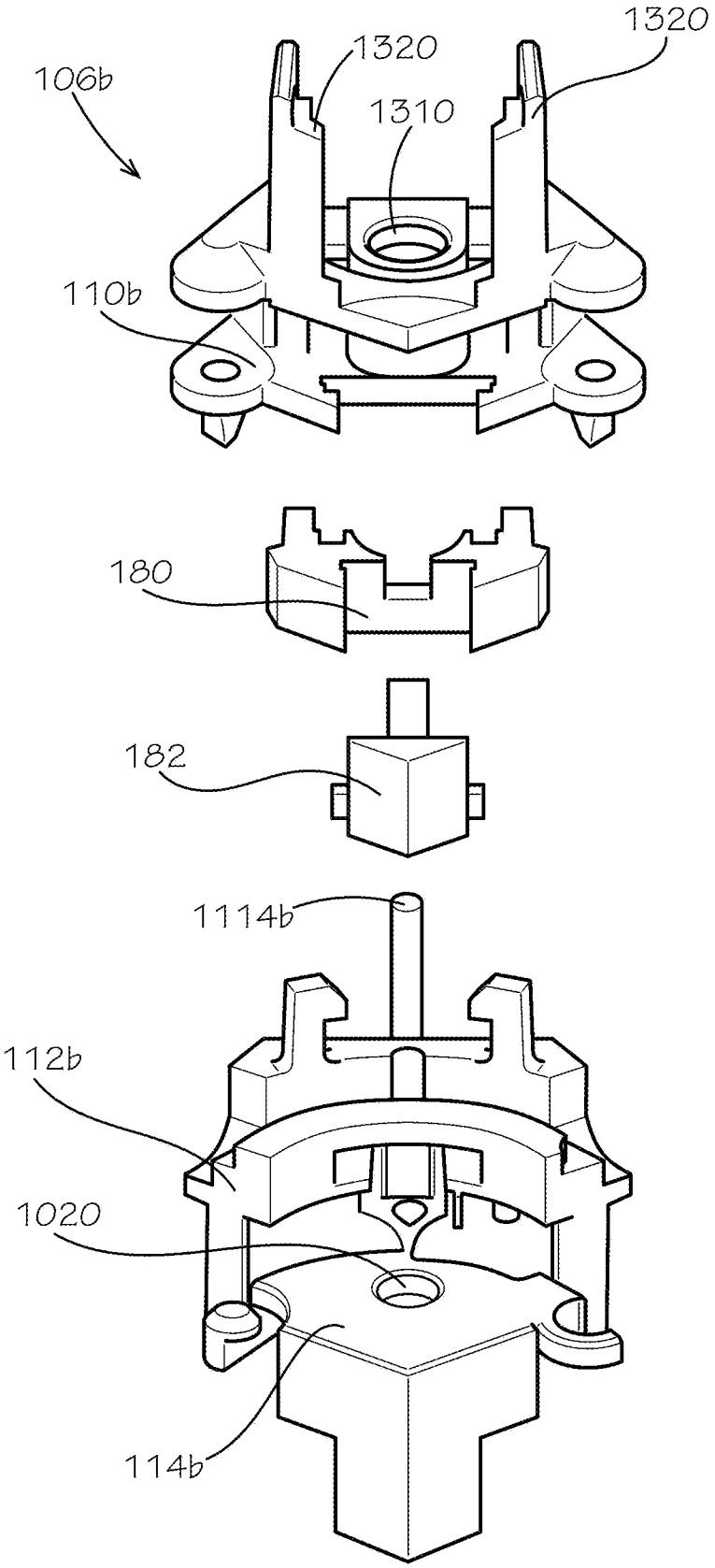
FIG. 13 is an exploded front view of a lower module of the center assembly of the device of FIG. 1.

FIG. 13 is an exploded front view of the lower module 106*b*. As previously described, the internal constraint piece 114*b* can define the pin hole 1020. The pin hole 1020 can receive an engagement tip 1432 (shown in FIG. 14) of spring pin 1410 (shown in FIG. 14) to maintain the internal constraint piece 114*b*, and indirectly the constraint spindle 814 (shown in FIG. 8), in the constraint position. Withdrawal of the engagement tip 1432 from the pin hole 1020, such as through triggering of the constraint actuation mechanism 498 (shown in FIGS. 4, 14, and 16-18) can allow the constraint spindle 814 and other constraint mechanism 198 (shown in FIG. 1) components to snap to the release position.

The top external piece 110*b* can define a vertically-oriented threaded pin hole 1310 for receiving the spring pin 1410. The top external piece 110*b* can also define a pair of guides 1320 extending upwards, which the push cap 480 (shown in FIG. 4) can ride upon.

Figure 14:
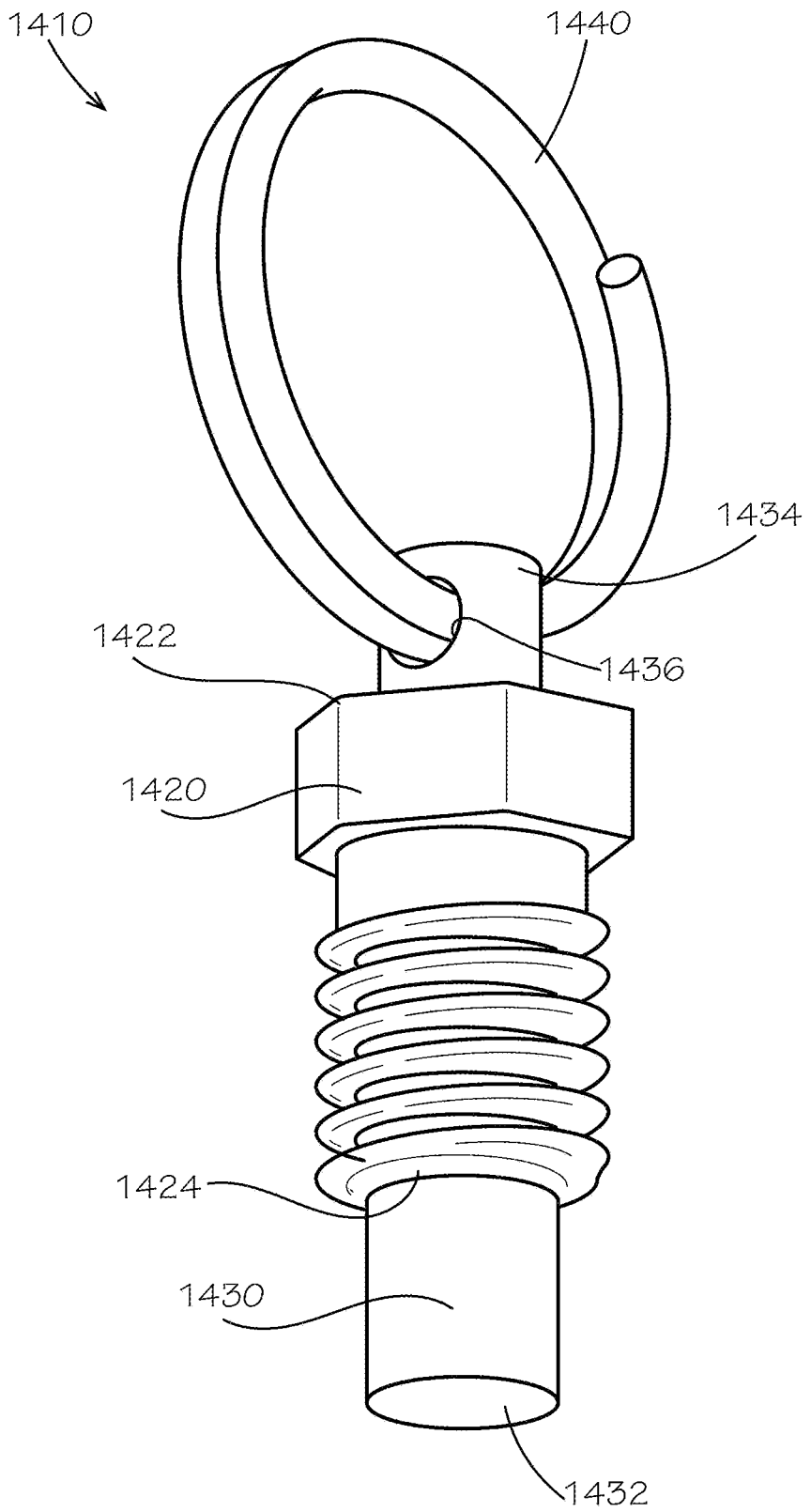
FIG. 14 is a perspective view of a conventional spring pin.

FIG. 14 is a perspective view of the spring pin 1410. The spring pin 1410 can be a conventional spring pin. The spring pin 1410 can comprise a threaded body bushing 1420, a sliding pin 1430, and a captured spring (not shown). The threaded body bushing 1420 can define a top bushing end 1422 and a bottom bushing end 1424. The sliding pin 1430 can define the engagement tip 1432 and a connecting end 1434, defined opposite from the engagement tip 1432. The threaded body bushing 1420 can also contain the captured spring, which can bias the engagement tip 1432 downwards and away from the top bushing end 1422. The connecting end 1434 can define a hole 1436 for receiving a controlling member 1440. In the present view, the controlling member 1440 shown is merely exemplary, and in the device 100 (shown in FIG. 1), the controlling member 1440 can be a bottom crossbar 1796 (shown in FIG. 17) of a plunger linkage 1794 (shown in FIG. 17). Pulling upwards on the controlling member 1440 with sufficient force to overcome the biasing force of the captured spring can draw the engagement tip 1432 of the sliding pin 1430 upwards towards the bottom bushing end 1424. Once the upwards force is released, the biasing force of the captured spring drives the engagement tip 1432 downwards and away from the top bushing end 1422.

Figure 15:
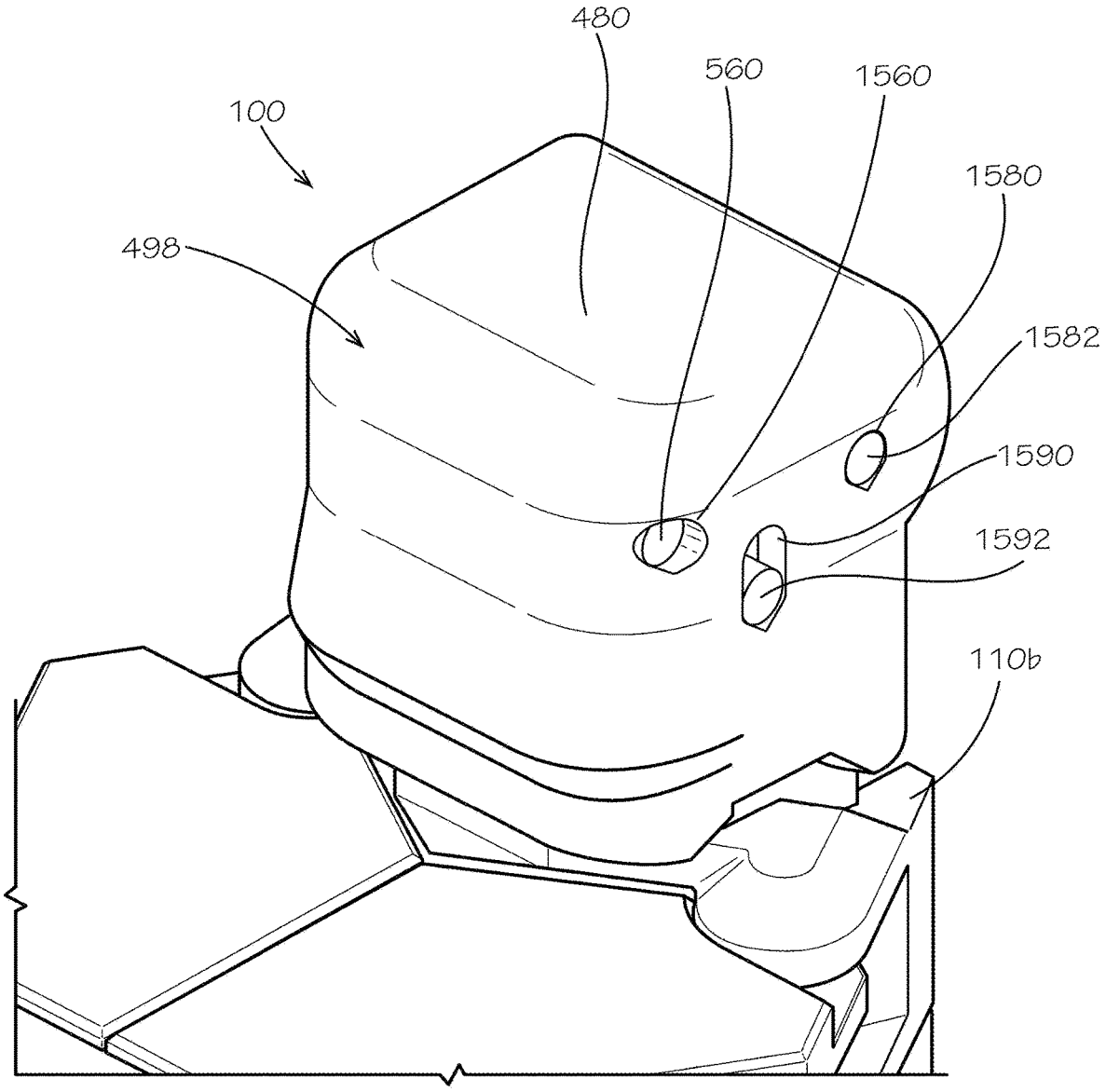
FIG. 15 is a detail view of a push cap of the center assembly of the device of FIG. 1.

FIG. 15 is a detail view of the push cap 480 of the center assembly 102*b*. The push cap 480 can travel upwards and downwards on the guides 1320 (shown in FIG. 13) of the top external piece 110*b*, in order to trigger the constraint actuation mechanism 498. The push cap 480 can define a push actuator pin hole 1560, an actuator linkage pin hole 1580, and a lever pin slot 1590. The push actuator pin hole 1560 can receive the push actuator pin 560, which can mount the push actuator 460 (shown in FIG. 4) within the push cap 480 as previously described above with respect to FIG. 5. The actuator linkage pin hole 1580 can receive the actuator linkage pin 1582, previously described with respect to FIG. 5. The lever pin slot 1590 can provide clearance for the push cap 480 to travel relative to a lever pin 1592 because the lever pin 1592 can be mounted to the guides 1320, as shown in FIG. 16.

Figure 17:
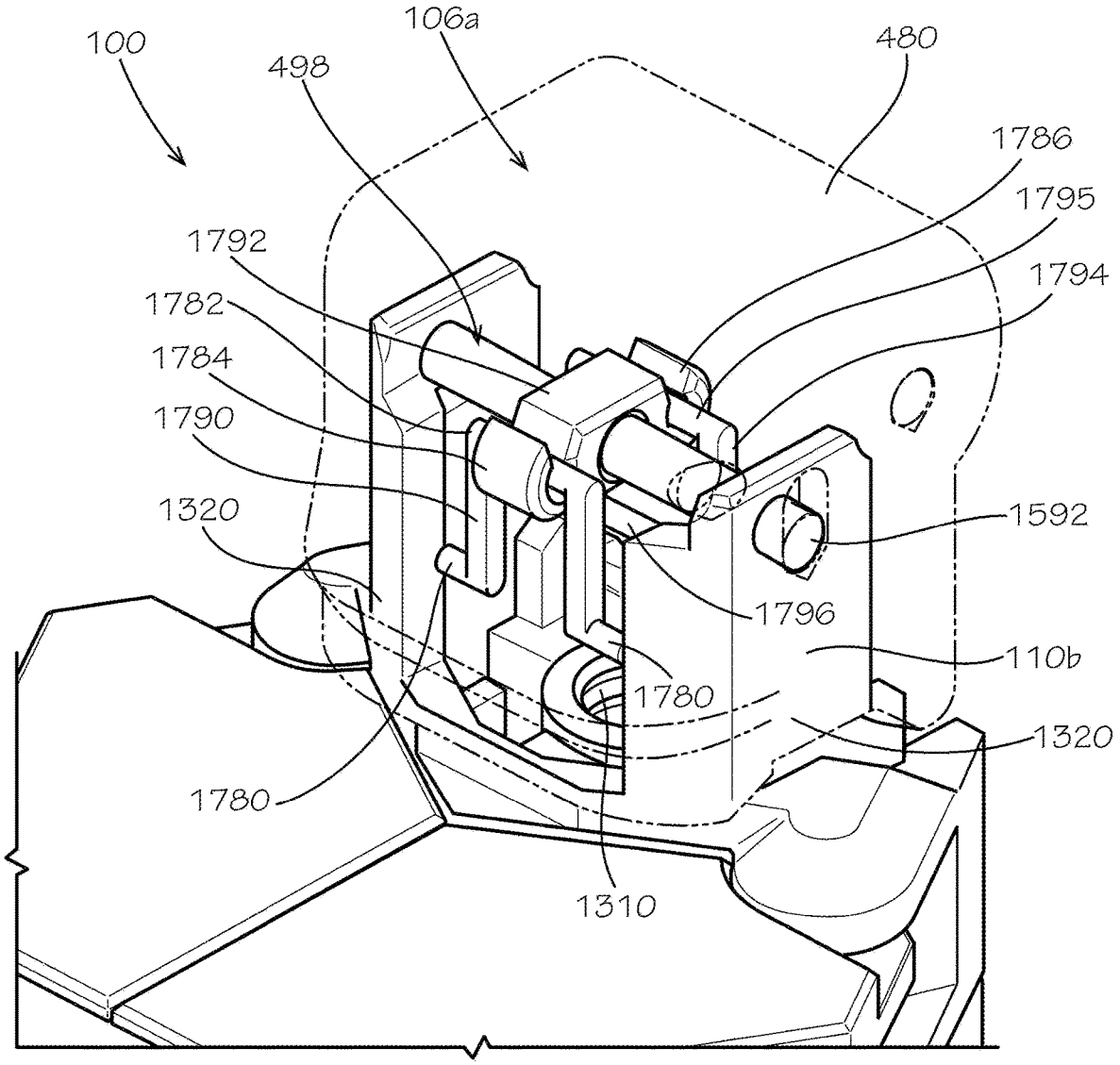
FIG. 17 a detail view of the upper module of the center assembly of the device of FIG. 1 with the push cap and the pivot actuation mechanism shown in transparency.

FIG. 16 is a detail view of the upper module 106*a* of the center assembly 102*b* with the push cap 480 shown in transparency, showing the linkages for the pivot actuation mechanism 496 and the constraint actuation mechanism 498. FIG. 17 is a detail view of the upper module 160*a* from the same perspective, with the pivot actuation mechanism 496 shown in transparency in addition to the push cap 480. The constraint actuation mechanism 498 can comprise the lever pin 1592, a push linkage 1790, a plunger lever 1792, a plunger linkage 1794, the push cap 480, and the spring pin 1410 (shown in FIG. 14). The push linkage 1790 can comprise a pair of legs 1780 and a crossbar 1782. The legs 1780 can attach to the push cap 480. The crossbar 1782 can be received by a first hook 1784 of the plunger lever 1792. A second hook 1786 can be defined by the plunger lever 1792 opposite from the first hook 1784. The second hook 1786 can engage a top crossbar 1795 of the plunger linkage 1794. The lever pin 1592 can extend through the plunger lever 1792 so that the plunger lever 1792 behaves in a seesaw fashion: a downward force on the push linkage 1790 translates into an upwards force on the plunger linkage 1794.

A bottom crossbar 1796 of the plunger linkage 1794 can extend through the hole 1436 (shown in FIG. 14) of the connecting end 1434 (shown in FIG. 14) of the spring pin 1410 (shown in FIG. 14). In this way, the plunger linkage 1794 can act as the controlling member 1440 (shown in FIG. 14) of the spring pin 1410. The threaded body bushing 1420 (shown in FIG. 14) can screw into the threaded pin hole 1310 of the top external piece 110*b*, with the engagement tip 1432 (shown in FIG. 14) oriented downwards to engage the pin hole 1020 (shown in FIG. 13) of the internal constraint piece 114*b* (shown in FIG. 13).

Figure 18:
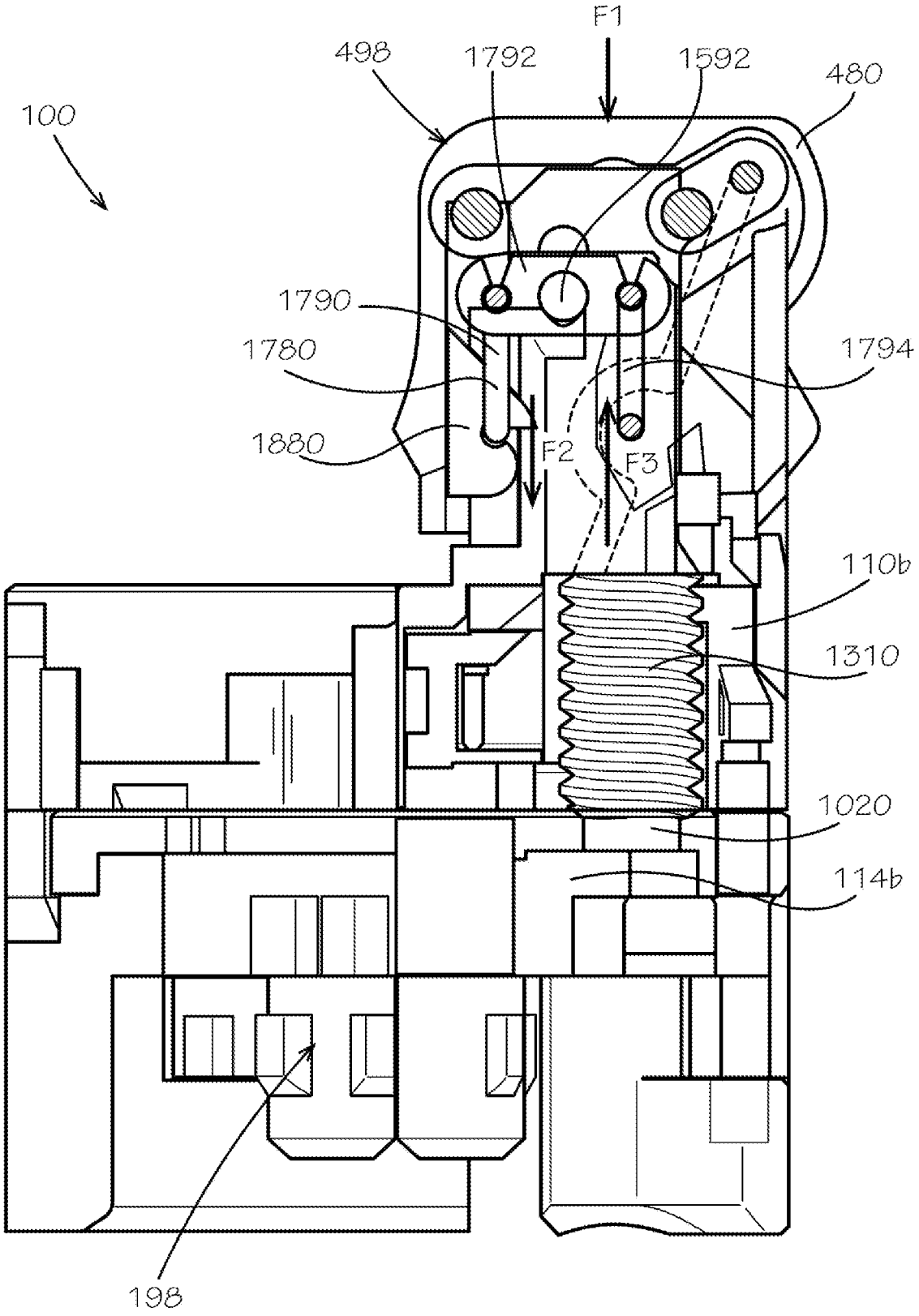
FIG. 18 is a cross-sectional view of the device of FIG. 1 taken along viewing line 18-18 shown in FIG. 9.

FIG. 18 is a cross-sectional view of the device 100 taken along viewing line 18-18 shown in FIG. 9, further illustrating operation of the constraint actuation mechanism 498. The push cap 480 can define an internal clip 1880 that can capture legs 1780 of push linkage 1790. When downward force F1 is exerted upon the push cap 480, it can translate to a downward force F2 on push linkage 1790. The plunger lever 1792 pivots around the lever pin 1592 so that the downward force on the push linkage 1790 can be converted into an upwards force F3 exerted on the plunger linkage 1794.

The plunger linkage 1794 can be connected to the hole 1436 (shown in FIG. 14) of the connecting end 1434 (shown in FIG. 14) of the spring pin 1410 (shown in FIG. 14). The threaded body bushing 1420 (shown in FIG. 14) can screw into the threaded pin hole 1310 of the top external piece 110*b*. In the constraint position, the engagement tip 1432 (shown in FIG. 14) can engage the pin hole 1020 of the internal constraint piece 114*b*. The upward force F3 acting through the plunger linkage 1794 on the connecting end 1434 of the spring pin 1410 can withdraw the engagement tip 1432 upwards from the pin hole 1020, thereby allowing the constraint mechanism 198 to snap to the release position under spring bias from the biasing element, such as torsion spring 1221, as described with respect to FIGS. 11 and 12.

The device 100 can be used according to the following exemplary method. First, a user can start with the device in the flat configuration (shown in FIGS. 1, 2, 4, 6) with the pivot mechanism 196 in the locked position (shown in FIG. 2) and the constraint mechanism 198 positioned in the constraint position (shown in FIGS. 5 and 8) to retain cartridges 700. The user can then depress the push actuator 460 of the pivot actuation mechanism 496, thereby repositioned the pivot mechanism 196 to the unlocked position (shown in FIG. 3) and allowing the device 100 to snap to the collapsed configuration (shown in FIGS. 3, 8, 9, 10, and 15-18) under bias from spring pressure.

Once in the collapsed configuration, the user can insert the cartridges 700 into the chambers of a revolver's cylinder while the cartridges 700 are still retained by the device 100. The user can then press the push cap 480 towards the top external piece 110*b* to trigger the constraint actuation mechanism 498, thereby allowing the constraint mechanism 198 to snap from the constraint position to the release position under spring bias. In the release position, the cartridges 700 can fall freely into the chambers, and the revolver's action can be closed to complete the loading of the weapon.

To reset the device, the reset tab 516 can be manually rotated against the spring bias until the constraint mechanism 198 is returned to the constraint position, at which point the spring pin 1410 of the constraint actuation mechanism 498 can engage the pin hole 1020 of the internal constraint piece 114*b*, thereby securing the constraint mechanism 198 in the constraint position. The wing assemblies 102*a,c* can then be folded outwards relative to the center assembly 102*b*, and the pivot mechanism 196 can be reset to the locked position by depressing the pivot lock 180 rearward towards the top external piece 110*b*. In some aspects, the pivot lock 180 can be manually reset by pressing the pivot lock 180 rearward with the user's fingers. In other aspects, a spring positioned between the pivot lock 180 and the pivot lock stop 182 can automatically move the pivot lock 180 back to the locked position once the wing assemblies 102*a,c* are folded to the flat configuration.

Figure 19:
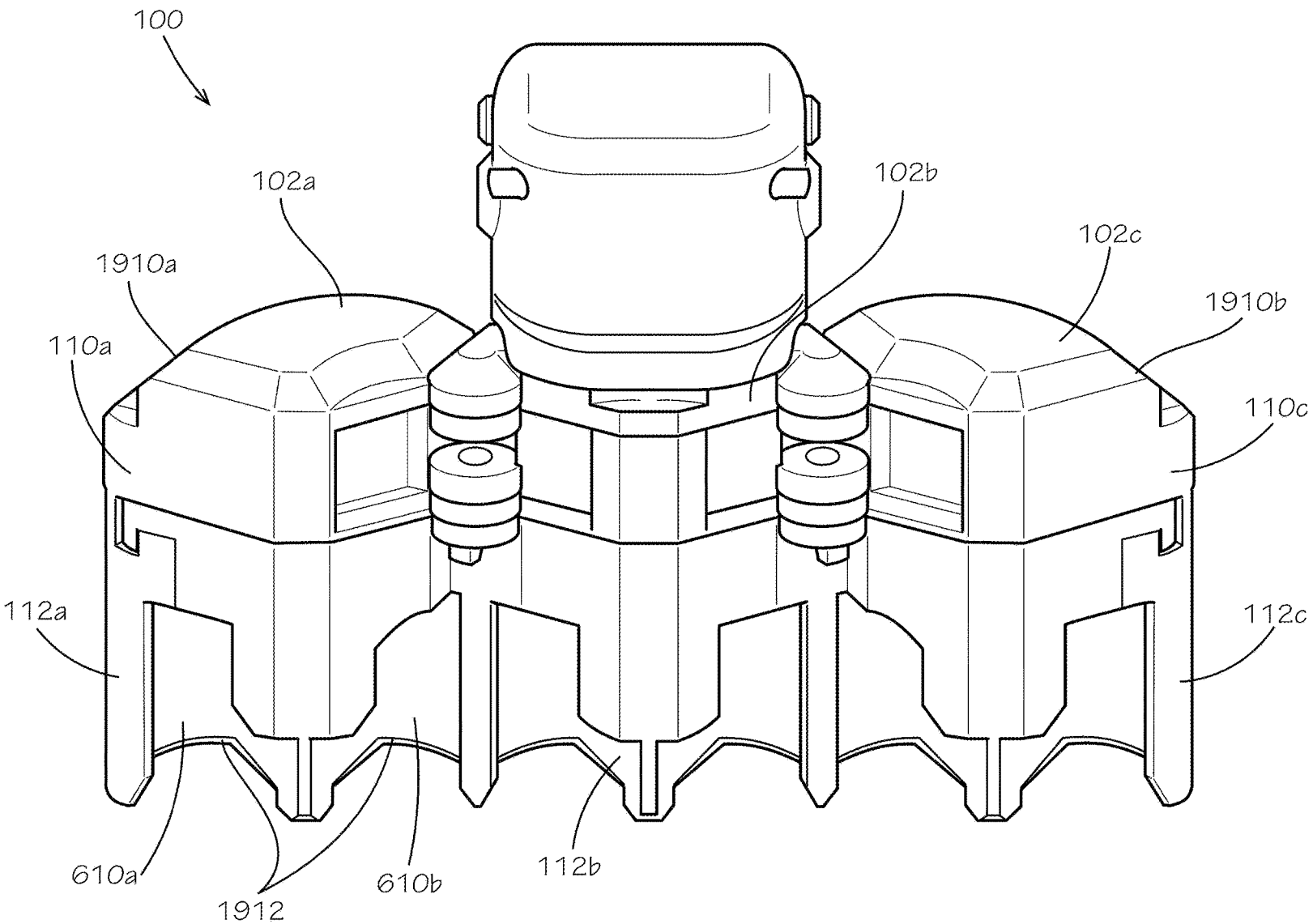
FIG. 19 is a front perspective top view of another aspect of the device in a flat configuration in accordance with another aspect of the present disclosure.

FIG. 19 is a front perspective view of another aspect of the device 100 in accordance with another aspect of the present disclosure. The top external pieces 110*a,c* of the wing assemblies 102*a,c* can define relieved shoulders 1910*a,b*. The relieved shoulders 1910*a,b* can define a chamfer, rounded corner, or other irregular contour such that corners of the top external pieces 110*a,c* opposite from the center assembly 102*b* can define a more rounded and less rectangular shape. The relieved shoulders 1910 can provide greater clearance for a grip of the revolver, which are typically wider than a frame of the revolver, when reloading the cylinder of the revolver. This allows the device 100 to be used with greater speed due to decreased interference. The relieved shoulders 1910*a,b* can also accommodate oversized grips that are favored by some shooters, such as target grips.

In the present aspect, the lower external pieces 112*a,b,c* can be extended further in a downward direction, away from the top external pieces 110*a,c*. The extended lower external pieces 112*a,b,c* can provide greater support and control when the device 100 holds cartridges 700 (shown in FIG. 7). As demonstrated by the lower external piece 112*a*, the scalloped walls 610*a,b* can define relief cuts 1912 extending upwards towards the top external pieces 110*a,c*. The relief cuts 1912 can provide clearance for a cylinder stop lug of the revolver, which can otherwise interfere with reloading the cylinder of the revolver.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A revolver reloading device comprising:

a first wing assembly defining a first cartridge pocket and a second cartridge pocket, the first cartridge pocket defining a first center point, the second cartridge pocket defining a second center point, the first wing assembly comprising an internal constraint piece and a lower external piece, the lower external piece at least partially defining the first cartridge pocket, the internal constraint piece defining an inner lug, the internal constraint piece being rotatable relative to the lower external piece about and between a constraint position and a release position, the inner lug extending into the first cartridge pocket in the constraint position, the inner lug being rotationally offset from the first cartridge pocket in the release position;

a second wing assembly defining a third cartridge pocket, the third cartridge pocket defining a third center point; and a center assembly hingedly coupled to the first wing assembly and the second wing assembly, the first wing assembly and the second wing assembly selectively rotatable relative to the center assembly about and between a flat configuration and a collapsed configuration, the first center point, the second center point, and the third center point being aligned in a linear arrangement in the flat configuration, the first center point, the second center point, and the third center point being aligned in a circular pattern in the collapsed configuration.

2. The revolver reloading device of claim 1, wherein:

the first wing assembly and the second wing assembly are biased towards the collapsed configuration;

the center assembly comprises a pivot mechanism comprising a pivot lock;

the pivot lock is selectively repositionable about and between a locked position and an unlocked position;

the first wing assembly and the second wing assembly are secured in the flat configuration by the pivot lock when the pivot lock is in the locked position; and the first wing assembly and the second wing assembly are released to rotate relative to the center assembly when the pivot lock is in the unlocked position.

3. The revolver reloading device of claim 2, wherein:

the center assembly further comprises a position actuation mechanism engaging the pivot lock; and the position actuation mechanism is configured to reposition the pivot lock from the locked position to the unlocked position when the position actuation mechanism is triggered.

4. The revolver reloading device of claim 1, wherein:

the center assembly defines a fourth cartridge pocket;

the fourth cartridge pocket defines a fourth center point;

the fourth center point is aligned in the linear arrangement in the flat configuration; and the fourth center point is aligned in the circular pattern in the collapsed configuration.

5. The revolver reloading device of claim 1, further comprising a cartridge defining a rim, the rim positioned within the first cartridge pocket, the inner lug engaging the rim in the constraint position and securing the cartridge within the first cartridge pocket, the inner lug disengaged from the rim in the release position and releasing the cartridge from the first cartridge pocket.

6. The revolver reloading device of claim 1, further comprising a biasing element, the biasing element biasing the internal constraint piece towards the release position.

7. A revolver reloading device comprising:

a first lower external piece at least partially defining a first cartridge pocket;

a first internal constraint piece defining an inner lug, the first internal constraint piece being rotatable relative to the first lower external piece about and between a constraint position and a release position, the inner lug extending into the first cartridge pocket in the constraint position, the inner lug being rotationally offset from the first cartridge pocket in the release position;

a second lower external piece hingedly coupled to the first lower external piece, the second lower external piece at least partially defining a second cartridge pocket and a second internal constraint piece hingedly coupled to the first internal constraint piece.

8. The revolver reloading device of claim 7, further comprising a constraint actuation mechanism, the first internal constraint piece being biased towards the release position, the constraint actuation mechanism configured to secure the first internal constraint piece in the constraint position until the constraint actuation mechanism is triggered.

9. The revolver reloading device of claim 8, wherein:

the second internal constraint piece is biased towards the release position; and the constraint actuation mechanism is configured to simultaneously release the first internal constraint piece and the second internal constraint piece when the constraint actuation mechanism is triggered.

10. The revolver reloading device of claim 8, wherein:

the constraint actuation mechanism comprises a spring pin;

the first internal constraint piece defines a pin hole;

the spring pin selectively engages the pin hole to secure the first internal constraint piece in the constraint position; and the spring pin is configured to withdraw from the pin hole when the constraint actuation mechanism is triggered.

11. The revolver reloading device of claim 7, wherein:

the first lower external piece at least partially defines a third cartridge pocket;

the inner lug is a first inner lug;

the first internal constraint piece defines a second inner lug; and the second inner lug extends into the third cartridge pocket in the constraint position.

12. The revolver reloading device of claim 7, further comprising a third lower external piece at least partially defining a third cartridge pocket, the third lower external piece being hingedly coupled to the first lower external piece, the second lower external piece and the third lower external piece being rotatable relative to the first lower external piece to a flat configuration, the first cartridge pocket, the second cartridge pocket, and the third cartridge pocket being aligned in a linear arrangement in the flat configuration.

13. A method of using a revolver reloading device, the method comprising:

loading a first cartridge, a second cartridge, and a third cartridge into a first cartridge pocket, a second cartridge pocket, and a third cartridge pocket of the revolver reloading device, the revolver reloading device comprising:

a first wing assembly defining the first cartridge pocket and the second cartridge pocket, the first wing assembly comprising a first internal constraint piece rotatable about and between a constraint position and a release position; and a center assembly hingedly coupled to the first wing assembly, the center assembly defining a third cartridge pocket, the center assembly comprising a second internal constraint piece rotatable about and between the constraint position and the release position;

repositioning the first internal constraint piece and the second internal constraint piece from the release position to the constraint position to secure the first cartridge, the second cartridge, and the third cartridge being secured in the revolver reloading device when the first internal constraint piece and the second internal constraint piece are in the constraint position; and folding the first wing assembly relative to the center assembly from a collapsed configuration to a flat configuration, the first cartridge pocket, the second cartridge pocket, and the third cartridge pocket being aligned in a linear arrangement in the flat configuration, the first cartridge pocket, the second cartridge pocket, and the third cartridge pocket being aligned in a circular pattern in the collapsed configuration.

14. The method of claim 13, further comprising triggering a position actuation mechanism to release the first wing assembly and the center assembly from the flat configuration to the collapsed configuration, the revolver reloading device comprising a biasing element which biases the first wing assembly and the center assembly towards the collapsed configuration, the position actuation mechanism securing the first wing assembly and the center assembly in the flat configuration until triggered.

15. The method of claim 14, further comprising triggering a constraint actuation mechanism to release the first internal constraint piece and the second internal constraint piece from the constraint position to the release position, the first internal constraint piece and the second internal constraint piece being biased towards the release position by a second biasing element, the constraint actuation mechanism configured to secure the first internal constraint piece and the second internal constraint piece in the constraint position until the constraint actuation mechanism is triggered.

16. The method of claim 15, further comprising releasing the first cartridge, the second cartridge, and the third cartridge from the first cartridge pocket, the second cartridge pocket, and the third cartridge pocket and into a first chamber, a second chamber, and a third chamber of a cylinder of a revolver.

17. A revolver reloading device comprising:

a first lower external piece at least partially defining a cartridge pocket;

a first internal constraint piece defining an inner lug, the first internal constraint piece being rotatable relative to the first lower external piece about and between a constraint position and a release position, the first internal constraint piece being biased towards the release position, the inner lug extending into the cartridge pocket in the constraint position, the inner lug being rotationally offset from the cartridge pocket in the release position;

a second lower external piece hingedly coupled to the first lower external piece;

a second internal constraint piece hingedly coupled to the first internal constraint piece, the second internal constraint piece being biased towards the release position; and a constraint actuation mechanism, the constraint actuation mechanism configured to secure the first internal constraint piece in the constraint position until the constraint actuation mechanism is triggered, the constraint actuation mechanism is configured to simultaneously release the first internal constraint piece and the second internal constraint piece when the constraint actuation mechanism is triggered.

18. A revolver reloading device comprising:

a lower external piece at least partially defining a cartridge pocket;

an internal constraint piece defining an inner lug, the internal constraint piece being rotatable relative to the lower external piece about and between a constraint position and a release position, the internal constraint piece being biased towards the release position, the inner lug extending into the cartridge pocket in the constraint position, the inner lug being rotationally offset from the cartridge pocket in the release position, the internal constraint piece defines a pin hole; and a constraint actuation mechanism, the constraint actuation mechanism comprising a spring pin, the spring pin selectively engaging the pin hole to secure the internal constraint piece in the constraint position, the constraint actuation mechanism configured to secure the internal constraint piece in the constraint position until the constraint actuation mechanism is triggered, the spring pin being configured to withdraw from the pin hole when the constraint actuation mechanism is triggered.

19. The revolver reloading device of claim 18, wherein:

the lower external piece is a first lower external piece;

the internal constraint piece is a first internal constraint piece;

the revolver reloading device further comprises a second lower external piece hingedly coupled to the first lower external piece;

the revolver reloading device further comprises a second internal constraint piece hingedly coupled to the first internal constraint piece;

the second internal constraint piece is biased towards the release position; and the constraint actuation mechanism is configured to simultaneously release the first internal constraint piece and the second internal constraint piece when the constraint actuation mechanism is triggered.

20. The revolver reloading device of claim 19, wherein:

the cartridge pocket is a first cartridge pocket; and the second lower external piece at least partially defines a second cartridge pocket.

* * * * *